US007223531B2

(12) United States Patent
Yoshioka

(10) Patent No.: US 7,223,531 B2
(45) Date of Patent: May 29, 2007

(54) PHOTOTHERMOGRAPHIC MATERIAL

(75) Inventor: Yasuhiro Yoshioka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/292,067

(22) Filed: Dec. 2, 2005

(65) Prior Publication Data

US 2006/0160038 A1 Jul. 20, 2006

(30) Foreign Application Priority Data

Jan. 17, 2005 (JP) ..... 2005-009310

(51) Int. Cl.
*G03C 1/498* (2006.01)
*G03C 1/30* (2006.01)

(52) U.S. Cl. ..... 430/619; 430/523; 430/531; 430/535; 430/621; 430/631; 430/640

(58) Field of Classification Search ..... 430/631, 430/523, 531, 619, 640, 535, 621
See application file for complete search history.

(56) References Cited

U.S. PATENT DOCUMENTS 6,132,949 A * 10/2000 Fujita et al. ..... 430/619
6,426,179 B1 * 7/2002 Slusarek et al. ..... 430/543

* cited by examiner

*Primary Examiner*—Thorl Chea
(74) *Attorney, Agent, or Firm*—Margaret A. Burke; Sheldon J. Moss

(57) ABSTRACT

The invention provides a photothermographic material containing, on a support, an image forming layer having at least a photosensitive silver halide, a non-photosensitive organic silver salt and a reducing agent, and at least one non-photosensitive layer, in which the non-photosensitive layer contains a crosslinking agent precursor, in which the crosslinking agent precursor is a compound which releases a crosslinking agent which crosslinks a binder of the non-photosensitive layer at the time of thermal development. A photothermographic material in which water resistance and scratch resistance of an image have been improved is provided.

23 Claims, No Drawings

PHOTOTHERMOGRAPHIC MATERIAL

CROSS-REFERENCE TO RELATED APPLICATION

This application claims priority under 35 USC 119 from Japanese Patent Application No. 2005-009310, the disclosure of which is incorporated by reference herein.

BACKGROUND OF THE INVENTION

1. Field of the Invention

The present invention relates to a photothermographic material.

2. Description of the Related Art

In recent years, in the field of films for medical diagnosis, there has been a strong desire for decreasing the amount of processing liquid waste from the viewpoints of protecting the environment and economy of space. Technology is therefore required for light sensitive photothermographic materials which can be exposed effectively by laser image setters or laser imagers and thermally developed to obtain clear black-toned images of high resolution and sharpness, for use in medical diagnostic applications and for use in photographic technical applications. The light sensitive photothermographic materials do not require liquid processing chemicals and can therefore be supplied to customers as a simpler and environmentally friendly thermal processing system.

While similar requirements also exist in the field of general image forming materials, images for medical imaging require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal developing image forming systems utilizing organic silver salts are known. In particular, photothermographic materials generally comprise an image forming layer in which a catalytically active amount of photocatalyst (for example, a silver halide), a reducing agent, a reducible silver salt (for example, an organic silver salt), and if necessary, a toner for controlling the color tone of developed silver images are dispersed in a binder. Photothermographic materials form a black silver image by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region. The Fuji Medical Dry Imager FM-DPL is an example of a practical medical image forming system using a photothermographic material that has been marketed.

Methods of manufacturing such a photothermographic material include a method of manufacture by a solvent coating, and a method of coating an aqueous coating solution using an aqueous dispersion of fine polymer particles or an aqueous solution of a water-soluble polymer as a main binder followed by drying. Since the latter method does not require a process of solvent recovery or the like, a production facility therefor is simple, environmental burden is small, and the method is advantageous for mass production.

In the case of the photothermographic material having an aqueous coated image forming layer, methods of using a hydrophobic latex as a main binder for the image forming layer in order to prevent moisture from influencing photographic performance are described in Japanese Patent Application Laid-Open (JP-A) Nos. 10-10670, 10-186568, and 2000-227643. All patents, patent publications, and non-patent literature cited in this specification are hereby expressly incorporated by reference herein. However, since the obtained images are usually handled and stored under various environmental conditions, image stability and image quality must be maintained under any environmental conditions. Nevertheless, the above materials have not reached the level of conventional wet developing silver halide photosensitive materials with regard to, for example, their resistances to grazing and scratches. The conventional wet developing silver halide materials include an additive, called a hardener, which can crosslink gelatin chains of gelatin binders to harden their membranes to improve resistance to water and resistance to scratches. However, until now photothermographic materials could not realize a satisfactory level of water resistance and scratch resistance. Maintaining high image quality while attaining good image storability is a very important and difficult task, which therefore continuously requires new technical development.

SUMMARY OF THE INVENTION

An aspect of the invention is to provide a photothermographic material comprising an image forming layer comprising at least a photosensitive silver halide, a non-photosensitive organic silver salt, and a reducing agent, and at least one non-photosensitive layer on a support, wherein the non-photosensitive layer comprises a crosslinking agent precursor, in which the crosslinking agent precursor is a compound which releases a crosslinking agent which crosslinks a binder of the non-photosensitive layer at the time of thermal development.

According to the present invention, a photothermographic material which exhibits improved image storability is provided. In particular, a photothermographic material, in which resistance to water and resistance to scratches of an image are improved, is provided.

DETAILED DESCRIPTION OF THE INVENTION

1. Photothermographic Material

The photothermographic material of the present invention has, on a support, an image forming layer and at least one non-photosensitive layer, in which the image forming layer contains at least a photosensitive silver halide, a non-photosensitive organic silver salt, a reducing agent, and a binder. The image forming layer may be disposed on one side of the support, or may be disposed on both sides of the support.

The non-photosensitive layer according to the present invention contains a binder and a crosslinking agent precursor. The crosslinking agent precursor is a compound which releases a crosslinking agent which crosslinks the binder of the non-photosensitive layer at the time of thermal development. The non-photosensitive layer according to the present invention may be a surface protective layer on the side of the support having thereon the image forming layer, or may be a back layer on the opposite side of the support from the image forming layer (hereinafter called a backside).

In the present invention, a photographic characteristic curve is a D-log E curve representing a relationship between the common logarithm (log E) of a light exposure value, i.e., the exposure energy, and the optical density (D), i.e., a scattered light photographic density, by plotting the former on the abscissa and the latter on the ordinate. In the present invention, average gradation represents a gradient of a line joining the points (fog+optical density of 0.5) and (fog+optical density of 2.5) on the photographic characteristic curve (i.e., the value equal to tan θ when the angle between the line and the abscissa is θ).

An average gradation of the photothermographic material according to the invention is preferably less than 10. The average gradation is more preferably in a range of from 2 to 6, and even more preferably from 2 to 5.

2. Crosslinking Agent Precursor

Concerning the crosslinking agent precursor used for the present invention, the structure of the crosslinking agent precursor is not particularly limited as far as the compound releases a compound having more than two functional groups reacting with polymer molecules used as a binder at the time of thermal development. Specific examples of the preferred functional group include an isocyanate group, a vinyl sulfone group, a chloroethyl sulfonyl group, and a dichlorotriazinyl group. Among these, more preferred is an isocyanate group.

Preferred crosslinking agent precursor used for the present invention is a compound represented by the following formula (C-1).

Formula (C-1)

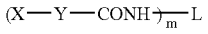

In formula (C-1), X represents an aromatic group or a heterocyclic group. Y represents one selected from an $SO_2NH$ group, an $SO_3$ group, a CONH group, a COOH group, or an NHNH group. L represents a linking group having a valency of from 2 to 6. m represents an integer of from 2 to 6.

When X is an aromatic group, specific examples of the aromatic group include a phenyl group, a naphthyl group, and the like, which may have a substituent. Preferred examples of the substituent include a halogen atom, an alkyl group, a hydroxy group, an alkoxy group, an aryloxy group, an acyloxy group, an amino group, a carbamide group, a sulfonamide group, a ureido group, a urethane group, an alkylthio group, an arylthio group, an acyl group, an oxycarbonyl group, a carbamoyl group, a sulfamoyl group, a sulfonyl group, a sulfoxide group, a cyano group, a nitro group, a heterocyclic group, and the like. Among these, preferred is an electron-attracting group. Specific examples of the electron-attracting group include a halogen atom, an acyl group, an oxycarbonyl group, a carbamoyl group, a sulfamoyl group, a sulfonyl group, a sulfoxide group, a cyano group, a nitro group, and a heterocyclic group. When X is an aromatic group, X is preferably substituted by at least one electron-attracting group, and particularly preferably, substituted by any group selected from an oxycarbonyl group, a carbamoyl group, a sulfamoyl group, a sulfonyl group, and a cyano group.

When X represents a heterocyclic group, specific examples of the heterocyclic group include pyridine, pyrazine, pyrimidine, pyridazine, triazine, quinoline, isoquinoline, naphthilizine, quinazoline, cinnoline, puterizine, pyrazole, imidazole, 1,2,4-trazole, benzimidazole, benztriazole, indole, thiazole, thiadiazole, and the like. These groups may have a substituent. As preferred substituent, similar substituent to those described in the above aromatic group can be described.

In the practice of the present invention, X is preferably an aromatic group substituted by a heterocyclic group or an electron-attracting group.

Y is preferably an $SO_2NH$ group, an $SO_3$ group, or an NHNH group, and more preferably, an $SO_2NH$ group or an NHNH group. L is preferably a group having a valency of from 2 to 4. m is preferably an integer of from 2 to 4. L is preferably an alkylene group, an alkylidene group, or a phenylene group. These groups may further bond to each other through another linking group, and may have a substituent.

In preferred embodiment of the present invention, X is a heterocyclic group and Y is an $SO_2NH$ group.

In another preferred embodiment, X is a heterocyclic group and Y is an NHNH group.

Particularly preferred compounds used for the present invention are the compounds represented by the following formula (C-2) or (C-3).

Formula (C-2)

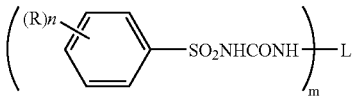

Formula (C-3)

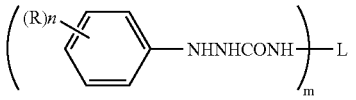

In formula (C-2) and (C-3), R represents a group substituting for a hydrogen atom on a benzene ring. n represents an integer of from 0 to 5. L represents a linking group having a valency of from 2 to 6. m represents an integer of from 2 to 6. Preferred examples of R include a halogen atom, an alkyl group, a hydroxy group, an alkoxy group, an aryloxy group, an acyloxy group, an amino group, a carbamide group, a sulfonamide group, a ureido group, a urethane group, an alkylthio group, an arylthio group, an acyl group, an oxycarbonyl group, a carbamoyl group, a sulfamoyl group, a sulfonyl group, a sulfoxide group, a cyano group, a nitro group, and a heterocyclic group. Among these, more preferred is an electron-attracting group. Specific examples of the electron-attracting group include a halogen atom, an acyl group, an oxycarbonyl group, a carbamoyl group, a sulfamoyl group, a sulfonyl group, a sulfoxide group, a cyano group, a nitro group, and a heterocyclic group. As R, particularly preferred are an oxycarbonyl group, a carbamoyl group, a sulfamoyl group, a sulfonyl group, and a cyano group.

n is preferably an integer of from 1 to 3. m is preferably an integer of from 2 to 4. L is preferably a linking group having a valency of from 2 to 4. In the case where n is two or more, it is particularly preferred that at least one among plural R is one selected from an oxycarbonyl group, a carbamoyl group, a sulfamoyl group, a sulfonyl group, or a cyano group.

Specific examples of the compound represented by formula (C-1), (C-2), or (C-3) are shown below, but the present invention is not limited to these specific examples.

1
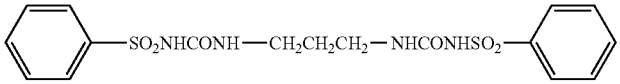
2
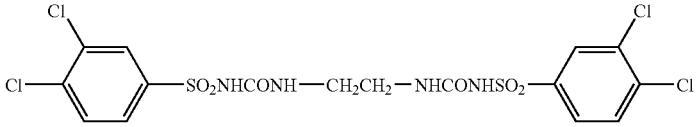
3
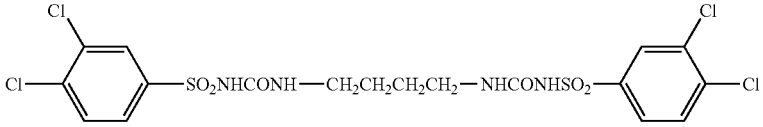
4
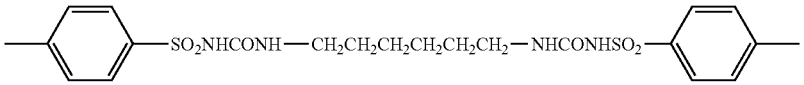
5
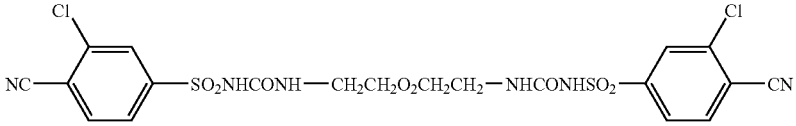
6
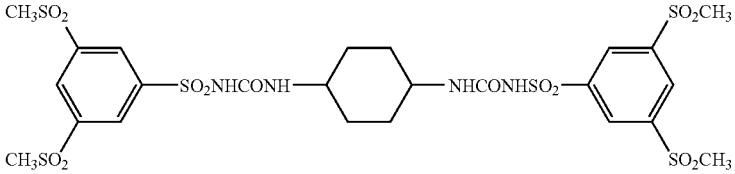
7
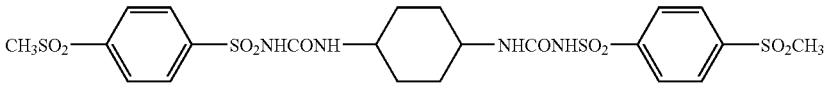
8
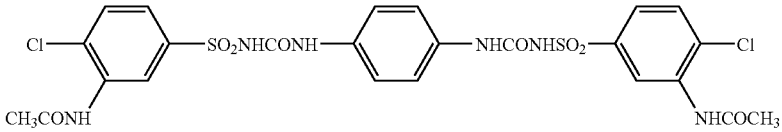
9
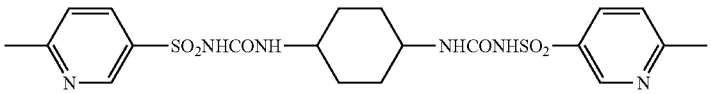
10
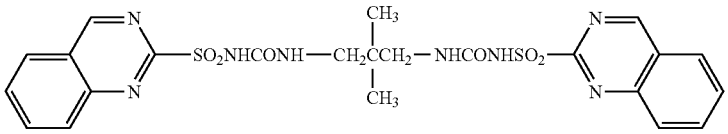
11
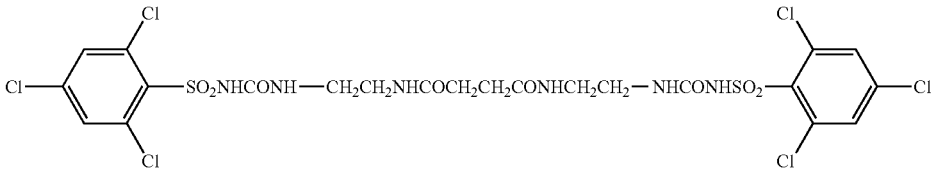

-continued
12
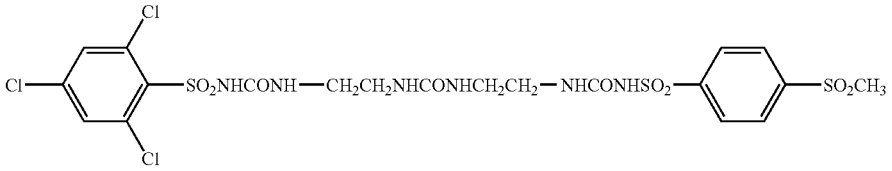
13
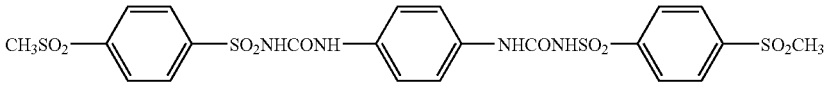
14
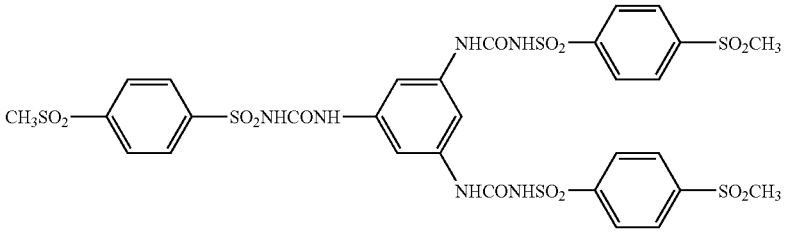
15
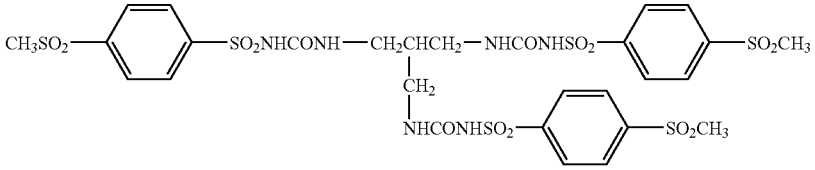
16
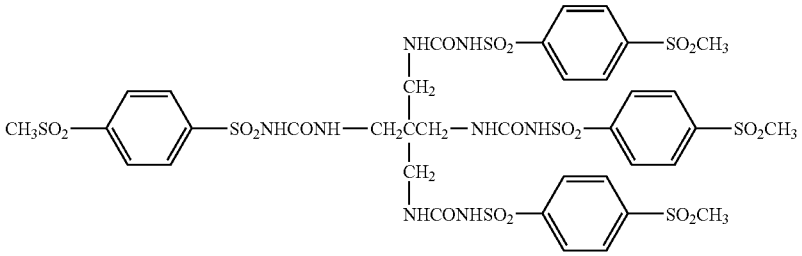
17
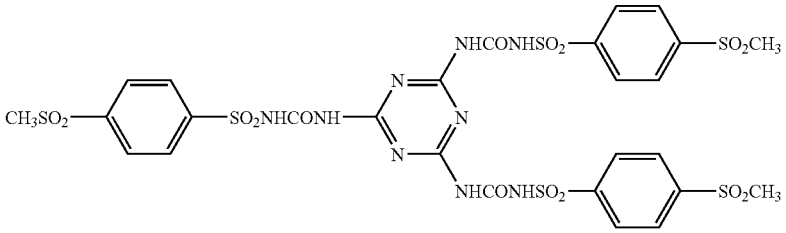
18
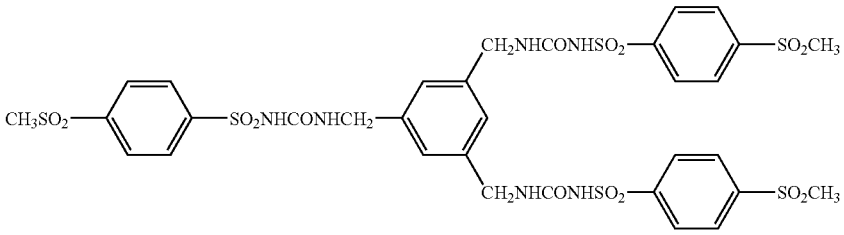
19
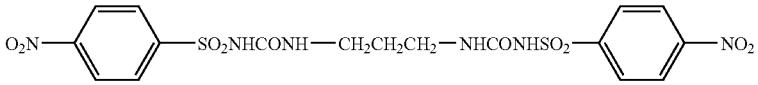

-continued
20
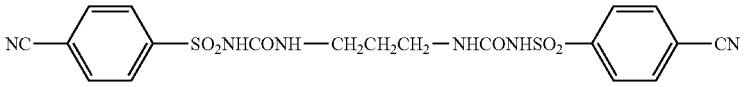
21
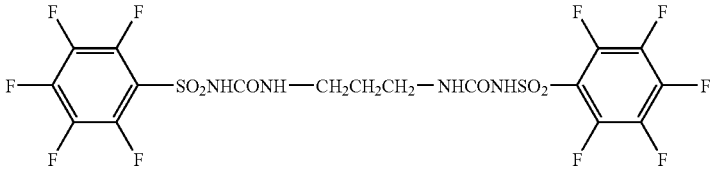
22
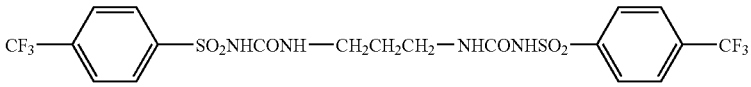
23
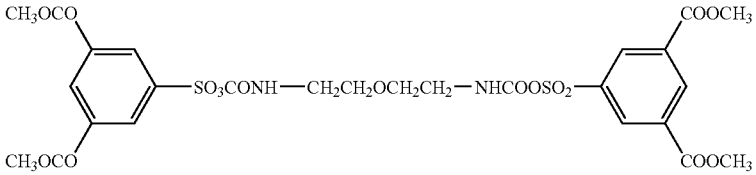
24
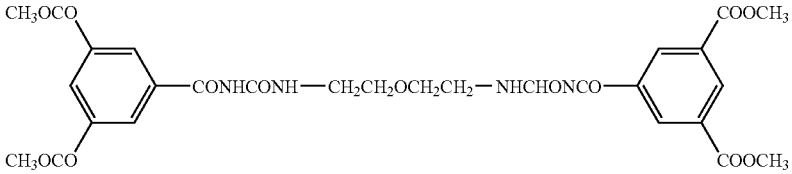
25
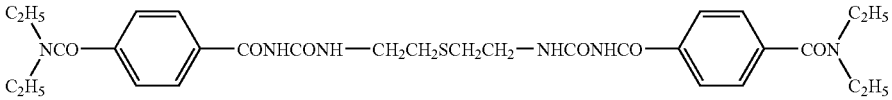
26
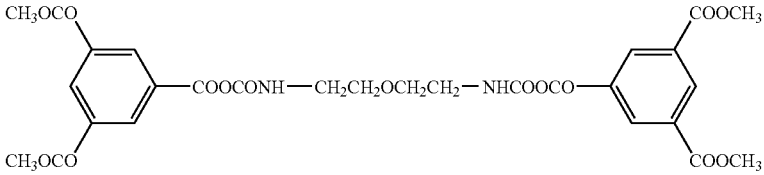
27
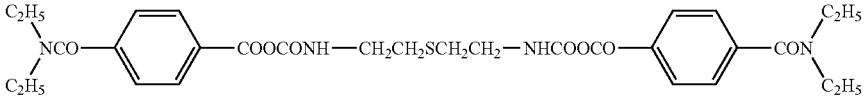
28
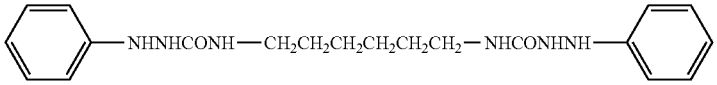
29
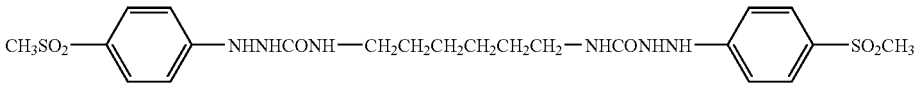
30
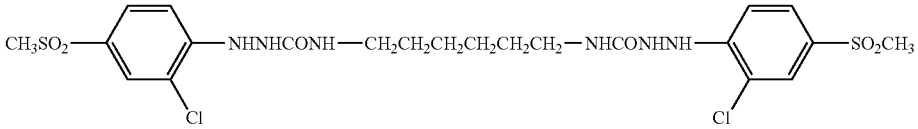
31
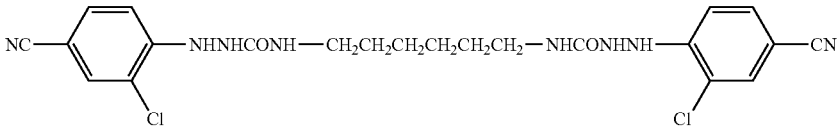

-continued
32
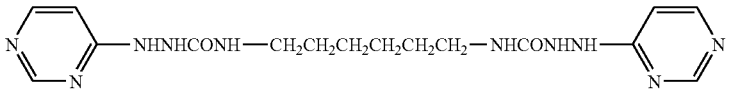
33
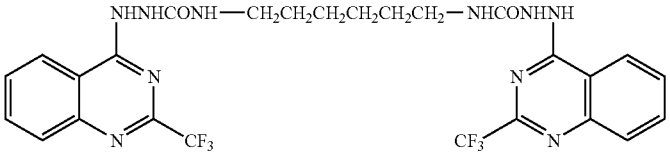
34
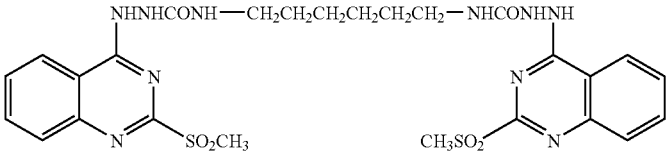
35
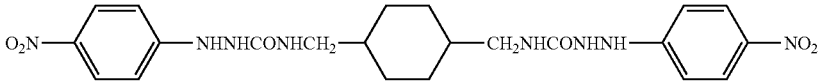
36
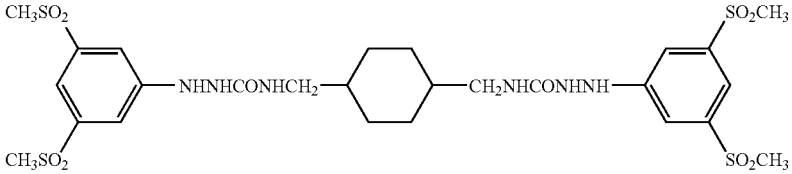
37
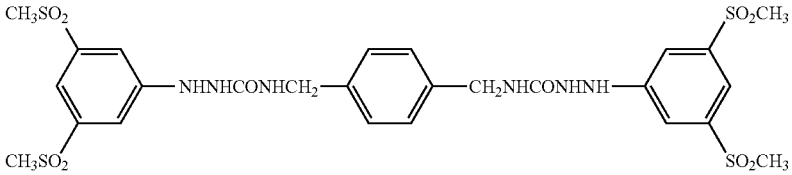
38
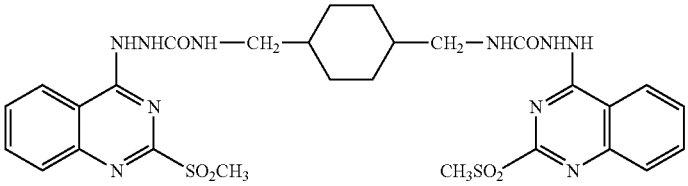
39
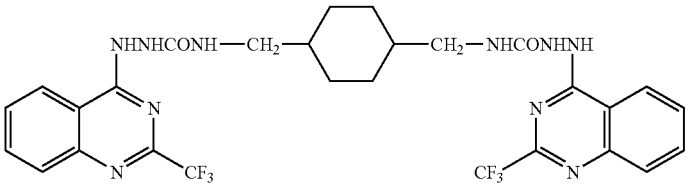
40
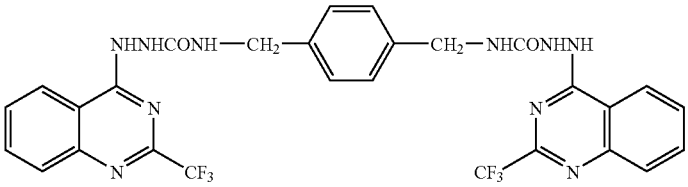

-continued
41
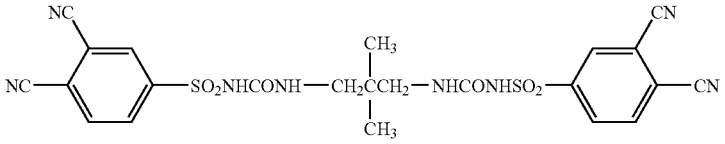
42
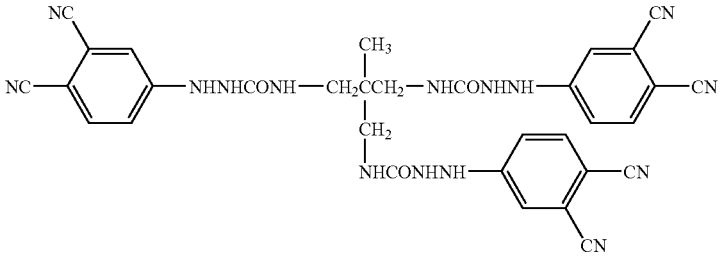
43
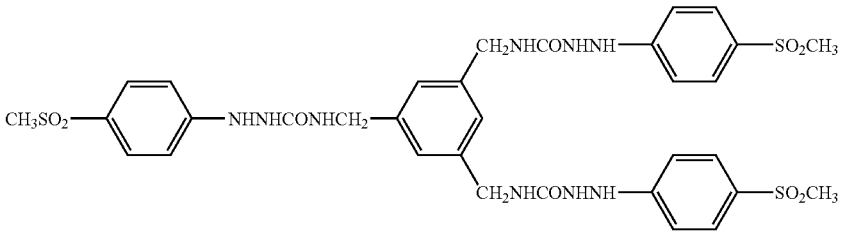
44
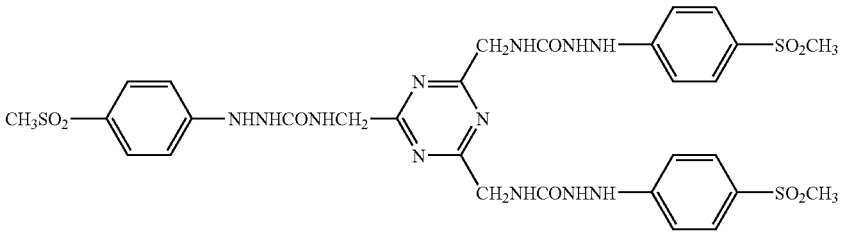
45
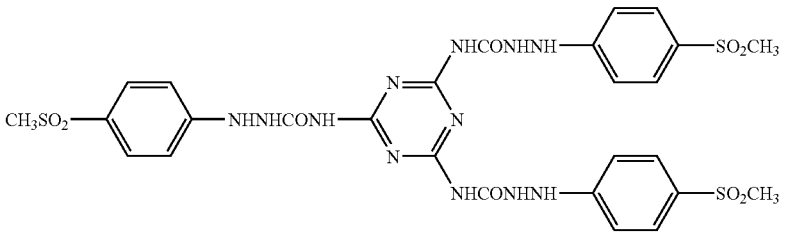
46
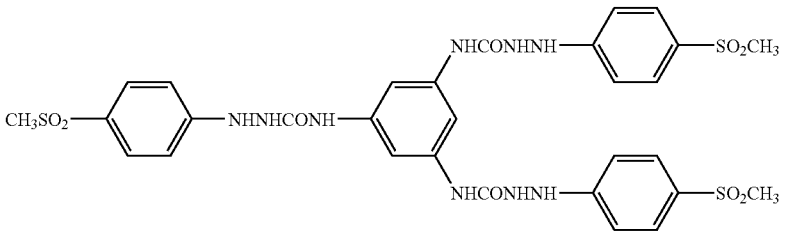

-continued
47
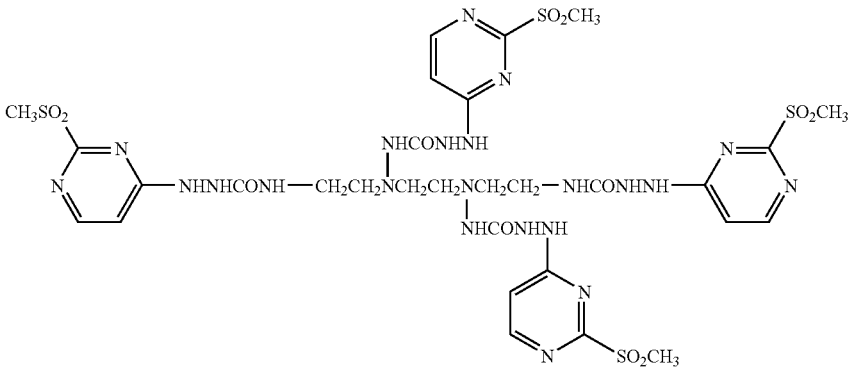
48
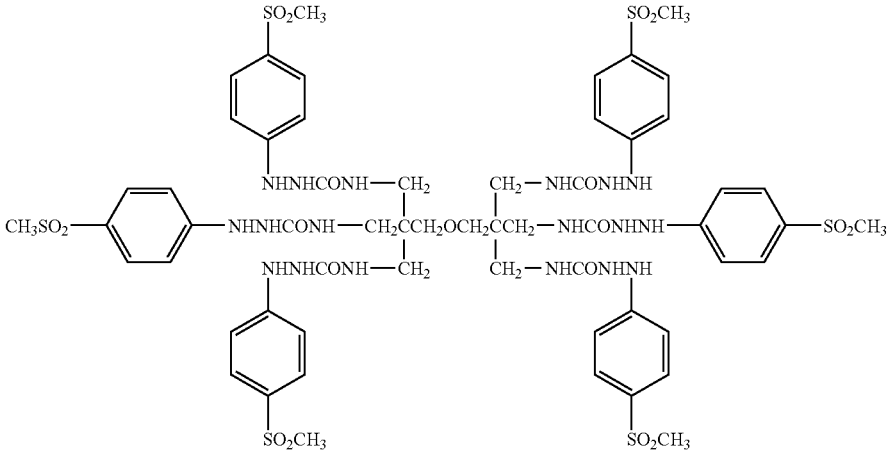
49
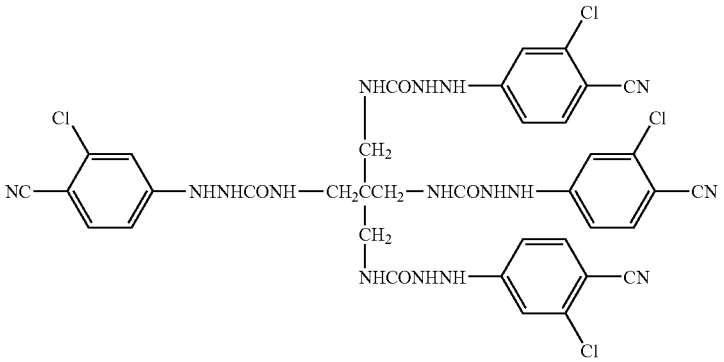
50
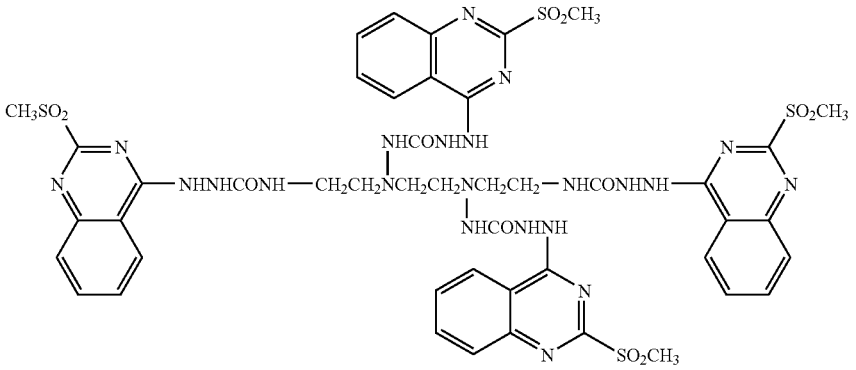

The addition amount of the compound of the present invention is in a range of from 0.01% by weight to 20% by weight, preferably from 0.05% by weight to 10% by weight, and more preferably from 0.1% by weight to 5% by weight, with respect to the polymer used as a binder. The compound of the present invention can be added by any method. Examples of the adding method include a method of adding the compound to a coating solution by dissolving the compound in a proper solvent (methanol, isopropyl alcohol, methylethyl ketone, cyclohexane, or the like), a method of adding the compound in the form of emulsified dispersion by means of colloid mill or the like in the presence of a protective colloid (gelatin, poly(vinyl pyrrolidone), poly (vinyl alcohol), or the like) and a surfactant (dodecylbenzenesulfonic acid sodium salt, oleoyl methyl urethane acid sodium salt, or the like) and by dissolving the compound in a proper high boiling point solvent (dibutyl phthalate, tricresyl phosphate, dioctyl sebacate, or the like) and an auxiliary solvent (ethyl acetate, cyclohexanone; or the like), and a method of adding in the form of solid dispersion comprising dispersing the powder of the compound by means of beads mill in the presence of a dispersing polymer (alkylthio modified poly(vinyl alcohol), poly(vinyl pyrrolidone), or the like) and a surfactant (triisopropylnaphthalenesulfonic acid sodium salt, dodecyl phenyloxybenzene disulfonic acid sodium salt, or the like).

In the practice of the present invention, it is preferred to add the compound as a solid dispersion.

3. Binder for Non-Photosensitive Layer

As the binder for the above-described non-photosensitive layer, polymers having a functional group which reacts with a crosslinking agent such as a hydroxy group, an amino group, a carboxy group, or the like are preferred, and gelatin, carrageenan, agar, poly(vinyl alcohol) and the like are described. Among them, gelatin and poly(vinyl alcohol) are preferable, and gelatin is more preferable from the viewpoint of high-speed coating ability.

From the viewpoint of enhancing water resistance, it is preferred that 50% or more of the binder of the non-photosensitive layer is formed by a polymer which is not derived from animal protein. As the polymer which is not derived from animal protein, water-soluble polymer which is not derived from animal protein and polymer latex which is dispersible in an aqueous solvent can be used.

3-1. Water-Soluble Polymer Which is not Derived from Animal Protein

In the present invention, a water-soluble polymer which is not derived from an animal protein means a natural polymer (polysaccharide series, microorganism series) except for animal protein, a semi-synthetic polymer (cellulose series, starch series, or alginic acid series), and a synthetic polymer (vinyl series or others) and corresponds to synthetic polymer such as poly(vinyl alcohol) described below and natural or semi-synthetic polymer made by cellulose or the like derived from plant as a raw material.

1) Poly(Vinyl Alcohols)

The water-soluble polymer which is not derived from an animal protein according to the present invention is preferably poly(vinyl alcohols).

As the poly(vinyl alcohols) (PVA) preferably used in the present invention, there are compounds that have various degree of saponification, degree of polymerization, degree of neutralization, modified compound, and copolymer with various monomers as described below.

As fully saponified compound, it can be selected among PVA-105 [poly(vinyl alcohol) (PVA) content: 94.0% by weight or more, degree of saponification: 98.5±0.5 mol %, content of sodium acetate: 1.5% by weight or less, volatile constituent: 5.0% by weight or less, viscosity (4% by weight at 20° C.): 5.6±0.4 CPS], PVA-110 [PVA content: 94.0% by weight, degree of saponification: 98.5±0.5 mol %, content of sodium acetate: 1.5% by weight, volatile constituent: 5.0% by weight, viscosity (4% by weight at 20° C.): 11.0±0.8 CPS], PVA-117 [PVA content: 94.0% by weight, degree of saponification: 98.5±0.5 mol %, content of sodium acetate: 1.0% by weight, volatile constituent: 5.0% by weight, viscosity (4% by weight at 20° C.): 28.0±3.0 CPS], PVA-117H [PVA content: 93.5% by weight, degree of saponification: 99.6±0.3 mol %, content of sodium acetate: 1.85% by weight, volatile constituent: 5.0% by weight, viscosity (4% by weight at 20° C.): 29.0±0.3 CPS], PVA-120 [PVA content: 94.0% by weight, degree of saponification: 98.5±0.5 mol %, content of sodium acetate: 1.0% by weight, volatile constituent: 5.0% by weight, viscosity (4% by weight at 20° C.): 39.5±4.5 CPS], PVA-124 [PVA content: 94.0% by weight, degree of saponification: 98.5±0.5 mol %, content of sodium acetate: 1.0% by weight, volatile constituent: 5.0% by weight, viscosity (4% by weight at 20° C.): 60.0±6.0 CPS], PVA-124H [PVA content: 93.5% by weight, degree of saponification: 99.6±0.3 mol %, content of sodium acetate: 1.85% by weight, volatile constituent: 5.0% by weight, viscosity (4% by weight at 20° C.): 61.0±6.0 CPS], PVA-CS [PVA content: 94.0% by weight, degree of saponification: 97.5±0.5 mol %, content of sodium acetate: 1.0% by weight, volatile constituent: 5.0% by weight, viscosity (4% by weight at 20° C.): 27.5±3.0 CPS], PVA-CST [PVA content: 94.0% by weight, degree of saponification: 96.0±0.5 mol %, content of sodium acetate: 1.0% by weight, volatile constituent: 5.0% by weight, viscosity (4% by weight at 20° C.): 27.0±3.0 CPS], PVA-HC [PVA content: 90.0% by weight, degree of saponification: 99.85 mol % or more, content of sodium acetate: 2.5% by weight, volatile constituent: 8.5% by weight, viscosity (4% by weight at 20° C.): 25.0±3.5 CPS] (above all trade names, produced by Kuraray Co., Ltd.), and the like.

As partial saponified compound, it can be selected among PVA-203 [PVA content: 94.0% by weight, degree of saponification: 88.0±1.5 mol %, content of sodium acetate: 1.0% by weight, volatile constituent: 5.0% by weight, viscosity (4% by weight at 20° C.): 3.4±0.2 CPS], PVA-204 [PVA content: 94.0% by weight, degree of saponification: 88.0±1.5 mol %, content of sodium acetate: 1.0% by weight, volatile constituent: 5.0% by weight, viscosity (4% by weight at 20° C.): 3.9±0.3 CPS], PVA-205 [PVA content: 94.0% by weight, degree of saponification: 88.0±1.5 mol %, content of sodium acetate: 1.0% by weight, volatile substance: 5.0% by weight, viscosity (4% by weight at 20° C.): 5.0±0.4 CPS], PVA-210 [PVA content: 94.0% by weight, degree of saponification: 88.0±1.0 mol %, content of sodium acetate: 1.0% by weight, volatile constituent: 5.0% by weight, viscosity (4% by weight at 20° C.): 9.0±1.0 CPS], PVA-217 [PVA content: 94.0% by weight, degree of saponification: 88.0±1.0 mol %, content of sodium acetate: 1.0% by weight, volatile constituent: 5.0% by weight, viscosity (4% by weight at 20° C.): 22.5±2.0 CPS], PVA-220 [PVA content: 94.0% by weight, degree of saponification: 88.0±1.0 mol %, content of sodium acetate: 1.0% by weight, volatile constituent: 5.0% by weight, viscosity (4% by weight at 20° C.): 30.0±3.0 CPS], PVA-224 [PVA content: 94.0% by weight, degree of saponification: 88.0±1.5 mol %, content of sodium acetate: 1.0% by weight, volatile constituent: 5.0% by weight, viscosity (4% by weight at 20° C.): 44.0±4.0 CPS], PVA-228 [PVA content: 94.0% by weight, degree of saponification: 88.0±1.5 mol %, content of sodium acetate: 1.0% by weight, volatile constituent: 5.0% by weight, viscosity (4% by weight at 20° C.): 65.0±5.0 CPS], PVA-235 [PVA content: 94.0% by weight, degree of saponification: 88.0±1.5 mol %, content of sodium acetate: 1.0% by weight, volatile constituent: 5.0% by weight, viscosity (4% by weight at 20° C.): 95.0±15.0 CPS], PVA-217EE [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-217E [PVA content: 94.0% by weight, degree of saponification: 88.0±1.0 mol %, content of sodium acetate: 1.0% by weight, volatile constituent: 5.0% by weight, viscosity (4% by weight at 20° C.): 23.0±3.0 CPS], PVA-220E [PVA content: 94.0% by weight, degree of saponification: 88.0±1.0 mol %, content of sodium acetate: 1.0% by weight, volatile constituent: 5.0% by weight, viscosity (4% by weight at 20° C.): 31.0±4.0 CPS], PVA-224E [PVA content: 94.0% by weight, degree of saponification: 88.0±1.0 mol %, content of sodium acetate: 1.0% by weight, volatile constituent: 5.0% by weight, viscosity (4% by weight at 20° C.): 45.0±5.0 CPS], PVA-403 [PVA content: 94.0% by weight, degree of saponification: 80.0±1.5 mol %, content of sodium acetate: 1.0% by weight, volatile constituent: 5.0% by weight, viscosity (4% by weight at 20° C.): 3.1±0.3 CPS], PVA-405 [PVA content: 94.0% by weight, degree of saponification: 81.5±1.5 mol %, content of sodium acetate: 1.0% by weight, volatile constituent: 5.0% by weight, viscosity (4% by weight at 20° C.): 4.8±0.4 CPS], PVA-420 [PVA content: 94.0% by weight, degree of saponification: 79.5.±1.5 mol %, content of sodium acetate: 1.0% by weight, volatile constituent: 5.0% by weight], PVA-613 [PVA content: 94.0% by weight, degree of saponification: 93.5±1.0 mol %, content of sodium acetate: 1.0% by weight, volatile constituent: 5.0% by weight, viscosity (4% by weight at 20° C.): 16.5±2.0 CPS], L-8 [PVA content: 96.0% by weight, degree of saponification: 71.0±1.5 mol %, content of sodium acetate: 1.0% by weight (ash), volatile constituent: 3.0% by weight, viscosity (4% by weight at 20° C.): 5.4±0.4 CPS] (above all are trade names, produced by Kuraray Co., Ltd.), and the like.

The above values were measured in the manner described in JISK-6726-1977.

As modified poly(vinyl alcohol), it can be selected among cationic modified compound, anionic modified compound, modified compound by —SH compound, modified compound by alkylthio compound and modified compound by silanol. Further, the modified poly(vinyl alcohol) described in "POVAL" (Koichi Nagano et. al., edited by Kobunshi Kankokai) can be used.

As this modified poly(vinyl alcohol) (modified PVA), there are C-118, C-318, C-318-2A, C-506 (above all are trade names, produced by Kuraray Co., Ltd.) as C-polymer, HL-12E, HL-1203 (above all are trade name, produced by Kuraray Co., Ltd.) as HL-polymer, HM-03, HM-N-03 (above all are trade marks, produced by Kuraray Co., Ltd.) as HM-polymer, M-115 (trade mark, produced by Kuraray Co., Ltd.) as M-polymer, MP-102, MP-202, MP-203 (above all are trade mark, produced by Kuraray Co., Ltd.) as MP-polymer, MPK-1, MPK-2, MPK-3, MPK-4, MPK-5, MPK-6 (above all are trade marks, produced by Kuraray Co., Ltd.) as MPK-polymer, R-1130, R-2105, R-2130 (above all are trade marks, produced by Kuraray Co., Ltd.) as R-polymer, V-2250 (trade mark, produced by Kuraray Co., Ltd.) as V-polymer, and the like.

Viscosity of aqueous solution of poly(vinyl alcohol) can be controlled or stabilized by addition of small amount of solvent or inorganic salts, which are described in detail in above literature "POVAL" (Koichi Nagano et. al., edited by Kobunshi Kankokai, pages 144 to 154). The typical example preferably is to include boric acid to improve the surface quality of coating. The addition amount of boric acid is preferably from 0.01% by weight to 40% by weight with respect to poly(vinyl alcohol).

It is also described in above-mentioned "POVAL" that the crystallization degree of poly(vinyl alcohol) is improved and waterproof property is improved by heat treatment. The binder used for the outermost layer of the present invention can be heated at coating-drying process or can be additionally subjected to heat treatment after drying, and therefore, poly(vinyl alcohol), which can be improved in water resistance during those processes, is particularly preferable among water-soluble polymers.

Furthermore, it is preferred that a waterproof improving agent such as those described in above "POVAL" (pages 256 to 261) is added to further enhance the water resistance. As examples, there can be mentioned aldehydes, methylol compounds (e.g., N-methylolurea, N-methylolmelamine, or the like), active vinyl compounds (divinylsulfones, derivatives thereof, or the like), bis(β-hydroxyethylsulfones), epoxy compounds (epichlorohydrin, derivatives thereof, or the like), polyvalent carboxylic acids (dicarboxylic acids, poly (acrylic acid) as poly(carboxylic acid), methyl vinyl ether/maleic acid copolymers, isobutylene/maleic anhydride copolymers, or the like), diisocyanates, and inorganic crosslinking agents (Cu, B, Al, Ti, Zr, Sn, V, Cr, or the like).

Many of these waterproof improving agents have an effect for water resistance, however, when they are used in the photothermographic material of the present invention, they have a bad influence on photosensitivity or development performance, therefore it is difficult to apply these. In the present invention, inorganic crosslinking agents are preferable as a waterproof improving agent. Among these inorganic crosslinking agents, boric acid and derivatives thereof are preferred and boric acid is particularly preferable. Specific examples of the boric acid derivative are shown below.

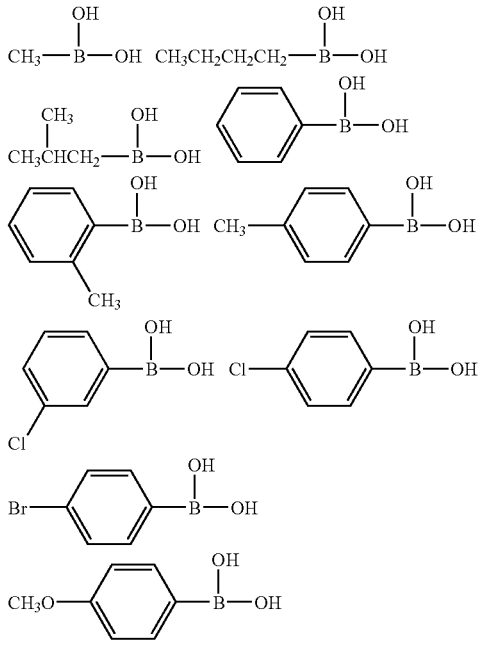

-continued

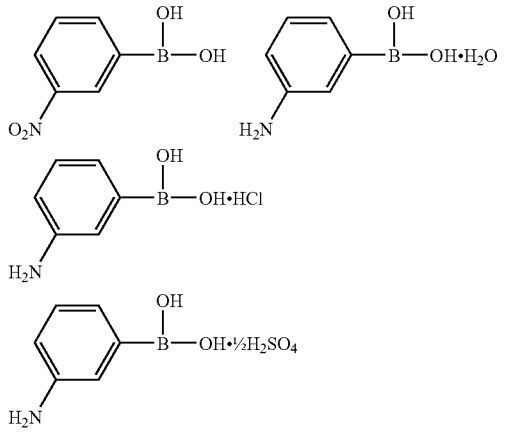

The addition amount of the waterproof improving agent is preferably in a range of from 0.01% by weight to 40% by weight with respect to poly(vinyl alcohol).

2) Other Water-Soluble Polymers not Derived from Animal Protein

Water-soluble polymers which are not derived from animal protein in the present invention besides above-mentioned poly(vinyl alcohols) are described below.

As typical examples, plant polysaccharides such as gum arabic, κ-carrageenan, l-carrageenan, λ-carrageenan, guar gum (Supercol produced by SQUALON Co., or the like), locust bean gum, pectin, tragacanth gum, corn starch (Purity-21 produced by National Starch & Chemical Co., or the like), starch phosphate (National 78-1898 produced by National Starch & Chemical Co., or the like), and the like are included.

Also as polysaccharides derived from microorganism, xanthan gum (Keltrol T produced by KELCO Co., or the like), dextrin (Nadex 360 produced by National Starch & Chemical Co., or the like) and as animal polysaccharides, sodium chondroitin sulfate (Cromoist CS produced by CRODA Co., or the like), and the like are included.

And as cellulose polymer, ethyl cellulose (Cellofas WLD produced by I.C.I. Co., or the like), carboxymethyl cellulose (CMC produced by Daicel Chemical Industries, Ltd., or the like), hydroxyethyl cellulose (HEC produced by Daicel Chemical Industries, Ltd., or the like), hydroxypropyl cellulose (Klucel produced by AQUQLON Co,. or the like), methyl cellulose (Viscontran produced by HENKEL Co., or the like), nitrocellulose (Isopropyl Wet produced by HELCLES Co., or the like), cationized cellulose (Crodacel QM produced by CRODA Co., or the like), and the like are included. As alginic acid series, sodium alginate (Keltone produced by KELCO Co., or the like), propylene glycol alginate, and the like and as other classification, cationized guar gum (Hi-care 1000 produced by ALCOLAC Co., or the like) and sodium hyaluronate (Hyalure produced by Lifecare Biomedial Co., or the like) are included.

As others, agar, furcelleran, guar gum, karaya gum, larch gum, guar seed gum, psylium seed gum, kino's seed gum, tamarind gum, tara gum and the like are included. Among them, highly water-soluble compound is preferable and the compound in which can solution sol-gel conversion can occur within 24 hours at a temperature change in a range of from 5° C. to 95° C. is preferably used.

As synthetic polymer, sodium polyacrylate, poly(acrylic acid) copolymers, polyacrylamide, polyacrylamide copolymers, and the like as acryl series, poly(vinyl pyrrolidone), poly(vinyl pyrrolidone) copolymers, and the like as vinyl series, and poly(ethylene glycol), poly(propylene glycol), poly(vinyl ether), poly(ethylene imine), poly(styrene sulfonic acid) and copolymers thereof, poly(acrylic acid) and copolymers thereof, poly(vinyl sulfanic acid) and copolymers thereof, maleic acid copolymers, maleic acid monoester copolymers, acryloylmethylpropane sulfonic acid and copolymers thereof, and the like are included.

High-water-absorbing polymers described in U.S. Pat. No. 4,960,681, JP-A No. 62-245260 and the like, namely such as homopolymers of vinyl monomer having —COOM or —$SO_3M$ (M represents a hydrogen atom or an alkali metal) or copolymers of their vinyl monomers or other vinyl monomers (e.g., sodium methacrylate, ammonium methacrylate, or Sumikagel L-5H produced by SUMITOMO KAGAKU Co.) can be also used.

Among them, water-soluble polymers preferably used are sodium aliginate, dextran, dextrin, methyl cellulose, carboxymethyl cellulose, hydroxyethyl cellulose, hydroxypropyl cellulose, poly(vinyl alcohol), polyacrylamide, poly (vinyl pyrrolidone), poly(ethylene glycol), poly(propyrene glycol), poly(styrene sulfonic acid) or a copolymer thereof, poly(acrylic acid) or a copolymer thereof, maleic acid monoester copolymer, acryloylmethylpropane sulfonic acid or a copolymer thereof, and the like. These compounds are described in detail in [Shin Suiyousei Porima No Ouyou to Shijou (New water-soluble polymer, its application and market)] edited by Shinzi Nagatomo, published by Shi Emu Shi Sha, Ltd. (1988).

3) Particularly Preferred Water-Soluble Polymer

Preferred polymer used for the present invention is a polymer having a functional group reacting with isocyanate group. One or plural kinds of polymer selected from the above polymer can be used without any special regulation.

Examples of the functional group which reacts with isocyanate group contained in the water-soluble polymer include a carboxy group or a salt thereof, a thiol group, a phenolic hydroxy group, a carboxylic anhydride group, an epoxy group, an amide group, an aromatic amino group, and the like, which can be used in combination. From the standpoint of reactivity with the isocyanate group, a carboxy group or a salt thereof and a carboxylic anhydride group are preferred, and from the standpoint of reactivity, particularly preferred is a carboxy group. The amount of functional group is not limited and can be selected arbitrary. However, the functional group may be preferably incorporated in such a ratio that the molecular weight is preferably from 100 to 20,000, more preferably from 500 to 10,000, per one equivalent weight of functional group. When the amount of functional group is too large, the hardened film is insufficient in mechanical strength, and water resistance and adhesive property to the substrate tend to degrade, whereas when the amount is too small, the film hardening property is poor and durability and water resistance tend to degrade.

The preferred water-soluble polymers used for the present invention is a water-soluble polymer having a group selected from a carboxy group or a salt thereof, a thiol group, a phenolic hydroxy group, a carboxylic anhydride group, an epoxy group, an amide group, or an aromatic amino group.

The above water-soluble polymer having the above-described carboxy group (thereafter, called polymer (A)) is not particularly limited. Polymer (A) can be easily prepared, for example, by a radical polymerization of monomer composition comprising a monomer having a carboxy group (thereafter called a carboxy group-containing monomer).

Specific examples of the carboxy group-containing monomer include unsaturated monocarboxylic acid such as methacrylic acid, crotonic acid, cinnamic acid, or the like; unsaturated dicarboxylic acid such as maleic acid, fumaric acid, itaconic acid, citraconic acid, or the like; monoesters of the unsaturated dicarboxylic acids; monoamides of the unsaturated dicarboxylic acids; unsaturated dicarboxylic anhydride such as maleic anhydride, itaconic anhydride, citraconic anhydride, or the like; and the like, but are not particularly limited to these examples. These carboxy group-containing monomers may be used alone or in combination of two or more thereof. Among the above illustrated carboxy group-containing monomer, preferred are unsaturated dicarboxylic acid, monoester of the dicarboxylic acid, monoamide of the dicarboxylic acid, and the dicarboxylic anhydride. Namely, dicarboxylic acid having an ethylene bond and derivatives thereof are preferred.

In the monomer composition (thereafter, called monomer composition (A)) containing the carboxy group-containing monomer, the ratio of the carboxy group-containing monomer is preferably in a range of from 1% by weight to 30% by weight.

The monomer other than the carboxy group-containing monomer included in the monomer composition (A), any monomers can be employed as far as the compound can copolymerize with the carboxy group-containing monomer and is inactive against the carboxy group, but are not particularly limited to the above. Specific examples of the monomer include styrene derivatives such as styrene, vinyl toluene, α-methyl styrene, chloromethyl styrene, styrene sulfonic acid or a salt thereof, and the like; methacrylamide derivatives such as methacrylamide, N-monomethyl methacrylamide, N-monoethyl methacrylamide, N,N-dimethyl methacrylamide, and the like; methacrylate esters which are obtained by esterification of methacrylic acid with alcohol having 1 to 18 carbon atoms, such as methyl methacrylate, ethyl methacrylate, butyl methacrylate, cyclohexyl methacrylate, and the like; hydroxy group-containing methacrylate esters such as 2-hydroxyethyl methacrylate, 2-hydroxypropyl methacrylate, monoester compound of methacrylic acid with polypropyrene glycol or polyethylene glycol, and the like; olefins such as ethylene, propyrene, n-butene, and the like; unsaturated sulfonic acids such as 2-ethylsulfonate methacrylate or a salt thereof, vinyl sulfonic acid or a salt thereof, and the like; vinyl esters such as vinyl acetate, vinyl propionate, vinyl stearate, and the like; methacrylonitrile; vinylethers such as methy vinylether, ethyl vinylether, octyl vinylether, lauryl vinylether, and the like; basic unsaturated monomers such as dimethylaminoethyl methacrylate, dimethylaminoethyl methacrylamide, dimethylaminopropyl methacrylamide, vinyl pyridine, vinyl imidazole, vinyl pyrrolidone, and the like; polyfunctional methacrylate esters having two or more ethylene bonds in the molecule, obtained by esterizing methacrylic acid with polyalcohols such as ethylene glycol, 1,3-butylene glycol, diethylene glycol, 1,6-hexane glycol, neopentyl glycol, polyethylene glycol, polypropylene glycol, trimethylol propane, pentaerythritol, dipentaerythritol, or the like; N-substituted methacrylamides such as N-methylol methacrylamide, N-butoxy methacrylamide, and the like; organic silicone-containing unsaturated monomers such as vinyl trimethoxy silane, γ-methacryloxypropyl trimethoxy silane, allyl triethoxy silane, trimethoxy silylpropyl allylamine, and the like; epoxy group-containing monomers such as glycidyl methacrylate, 2-methyl glycidyl methacrylate, ally glycidyl ether, and the like; aziridinyl group-containing monomers such as methacryloyl aziridine, 2-aziridinyl ethyl methacrylate, and the like; vinyl fluoride, vinylidene fluoride, vinyl chloride, vinylidene chloride, divinyl benzene, dially phthalate; piperidine derivatives such as 4-methacryloyloxy-2,2,6,6-tetramethyl piperidine, 4-methacryloylamino-2,2,6,6-tetramethyl piperidine, 4-methacryloyloxy-1,2,2,6,6-pentamethyl piperidine, and the like; and the like. These monomers may be used alone or in combination of two or more thereof. The piperidine derivatives described above are monomers having stability in ultraviolet light.

Any known methods can be applied for producing polymer (A), namely, polymerizing method of monomer composition (A), but are not particularly limited. Examples of preferred polymerizing methods include a solution polymerization, an emulsion polymerization, a suspension polymerization, and a block polymerization, which are carried out in a water-miscible solvent.

Specific examples of the preferred solvents include lower alcohols such as methyl alcohol, ethyl alcohol, n-propyl alcohol, isopropyl alcohol, n-butyl alcohol, t-butyl alcohol, and the like; glycols such as ethylene glycol, ethylene glycol monomethyl ether, ethylene glycol monobutyl ether, diethylene glycol, propylene glycol monomethylether, and the like; ketones such as acetone, methylethyl ketone, methylisobutyl ketone, and the like. These solvents may be used alone or in combination of two or more thereof.

The reaction condition can be determined depending on the constitution of the monomer composition (A) and the like, but are not particularly limited to. For example, the reaction temperature is preferably set from a room temperature to 200° C. The monomer composition (A) may be prepared simultaneously in a reaction vessel, or sequentially or stepwise by means of a dropping device. The polymerization reactions mentioned above are more preferably conducted under an atmosphere of inactive gas such as nitrogen gas or the like.

In the above polymerization reaction, a polymerization initiator, for example, an azo compound such as 2,2'-azobisisobutylonitrile, 2,2'-azobis(2-amino dipropane) dihydrochloric acid salt, or the like; persulfate such as potassium persulfate or the like; a peroxide compound such as benzoyl peroxide, di-t-butyl peroxide, or the like is used. The addition amount of the polymerization initiator can be determined depending on the constitution of the monomer composition (A) and the like, but are not particularly limited to. The amount is preferably from 0.1% by weight to 10% by weight, with respect to the monomer composition (A). The polymerization initiator may be added into a reaction vessel simultaneously with the monomer composition (A), or sequentially or stepwise by means of a dropping device.

As for the above polymerization reaction, a surfactant, a chain-transfer agent, a chain reaction moderator, or the like can be employed, if necessary. Polymer (A) can be obtained in a form of dissolved or dispersed state in a solvent thereof by the above polymerization reaction. Polymer (A) can be used alone or in combination of two or more thereof. The average molecular weight (polymerization ratio) is not particularly limited. The solvent therein can be distilled out partially or completely, if necessary.

In the case where an unsaturated dicarboxylic anhydride is used for the carboxy group-containing monomer, the said anhydride is subjected to open the ring to form two carboxy groups in the obtained polymer (A). In this case, either one of the above carboxy groups is preferably esterified or amidated after the polymerization reaction. Examples of the preferred esterification agent include relatively low molecular weight alcohols such as methyl alcohol, ethyl alcohol, n-propyl alcohol, isopropyl alcohol, n-butyl alcohol, isobutyl alcohol, t-butyl alcohol, methyl cellusolve, dimethylamino ethyl alcohol, diethylamino ethyl alcohol, acetonyl alcohol, and the like. Among the illustrated esterification agents, more preferred are t-butyl alcohol, dimethylamino ethyl alcohol, diethylamino ethyl alcohol, and acetonyl alcohol. Examples of the preferred amidation agent include relatively low molecular weight amines such as ethyl amine, butyl amine, aniline, and the like. Among the illustrated amidation agents, aniline is more preferred. The reaction condition of esterification or amidation can be determined depending on the constitution of polymer (A) and the like, but are not particularly limited to. For example, the reaction temperature is preferably set from a room temperature to 120° C.

As polymer (A) described above, known resins such as fluororesin, silicone acrylic resin, polyurethane resin, polyolefin resin, and the like can also be used other than acrylic resin.

The acid value of polymer (A) is preferably in a range of from 30 mg KOH/g to 200 mg KOH/g. By setting the acid value of polymer (A) in the range above, the hardened compounds obtained by utilizing the water dispersion of the resin composition for paints, coating aids, sealants, sealing agents, or the like may exhibit more improvement in various physical properties such as water resistance, solvent resistance, hardness, acid rain-resistance, anti-stain, workability, adhesion, stretch, shock resistance, and the like.

As an example of polymer (A), the following carboxy group-modified poly(vinyl alcohol) can be also preferably used.

The "carboxy group-modified poly(vinyl alcohol)" herein means a reaction product which is obtained by saponification partially or completely after copolymerizing a polymerizable carboxy group-containing monomer such as acrylic acid, methacrylic acid, itaconic acid, or the like with vinyl acetate. As commercial products, there are KL-118, KL-318, KL-506, KL-118, and the like (K Polymer series, trade name, available from Kurary Co., Ltd.).

Among the preferred water-soluble polymers used for the present invention, a water-soluble polymer having a functional group other than a carboxy group (a thiol group, a phenolic hydroxide group, a carboxylic anhydride group, an epoxy group, an amide group, or an aromatic amine group) can be easily prepared in a similar manner (for example, radical polymerization) by utilizing the monomer having the respective functional groups mentioned above or the monomer capable of adding the functional group thereto by modification after polymerization in place of the carboxy group-containing monomer.

Plural kinds of functional groups may be included in the water-soluble polymer.

Particularly preferred is a water-soluble polymer having a carboxy group or a salt thereof.

The addition amount of the water-soluble polymer is preferably from 0.3 g/m$^2$ to 4.0 g/m$^2$ per 1 m$^2$ of the support, and more preferably from 0.5 g/m$^2$ to 2.0 g/m$^2$. When the water-soluble polymer of the present invention is used in the outermost layer on the backside, similar addition amount is preferred.

It is preferred that the concentration of the water-soluble polymer in a coating solution is arranged to have suitable viscosity for simultaneous overlaying coating after the addition, but it is not particularly limited. Generally, the concentration of the water-soluble polymer in a solution is from 0.01% by weight to 30% by weight, and is preferably from 0.05% by weight to 20% by weight, and particularly preferably from 0.1% by weight to 10% by weight. The viscosity gain obtained by these addition is preferably from 1 mPa·s to 200 mPa·s with respect to the previous viscosity, and more preferably from 5 mPa·s to 100 mPa·s. The viscosities mentioned above were measured with B-type rotating viscosity meter at 25° C. The glass transition temperature of the water-soluble polymer preferably used in the present invention is not particularly limited, but is preferably from 60° C. to 220° C. from the viewpoint of brittleness such as a belt mark by thermal development, dust adhering at manufacturing, or the like. It is more preferably from 70° C. to 200° C., even more preferably from 80° C. to 180° C., and most preferably from 90° C. to 170° C.

A polymer which is dispersible to an aqueous solvent may be used in combination with the water-soluble polymer or the hydrophobic polymer latex of the present invention.

Suitable polymers dispersible to an aqueous solvent are described below in the explanation of polymer latex in the explanation of (binder for image forming layer), but are those that are synthetic resin or polymer and their copolymer; or media forming a film; for example, included are cellulose acetates, cellulose acetate butyrates, poly(methylmethacrylic acids), poly(vinyl chlorides), poly(methacrylic acids), styrene-maleic anhydride copolymers, styrene-acrylonitrile copolymers, styrene-butadiene copolymers, poly(vinyl acetals) (for example, poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides.

The polymer is mixed in an amount of from 1% by weight to 70% by weight, and preferably from 5% by weight to 50% by weight, with respect to the water-soluble polymer.

3-2. Polymer Latex

In the present invention, the polymer latex which can be used as a binder of the outermost layer may be in a state in which water-insoluble fine particles of hydrophobic polymer are dispersed in water.

An average particle size of the dispersed particles is in a range from 1 nm to 50000 nm, preferably from 5 nm to 1000 nm, more preferably from 10 nm to 500 nm, and even more preferably from 50 nm to 200 nm. There is no particular limitation concerning particle size distribution of the dispersed particles, and they may be widely distributed or may exhibit a monodisperse particle size distribution. From the viewpoint of controlling the physical properties of the coating solution, preferred mode of usage includes mixing two or more types of particles each having monodisperse particle distribution.

In the present invention, hydrophobic polymer such as acrylic polymer, polyesters, rubbers (e.g., SBR resin), polyurethanes, poly(vinyl chlorides), poly(vinyl acetates), poly(vinylidene chlorides), polyolefins, or the like is preferably used as the latex polymer. These polymers may be straight chain polymers, branched polymers, or crosslinked polymers; also may be so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range of from 5,000 to 1,000,000, and preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

The glass transition temperature (Tg) of the polymer latex which can be used in the outermost layer of the present invention is preferably in a range of from −20° C. to 70° C., more preferably from −20° C. to 40° C. and, most preferably from −20° C. to 20° C. However, it is possible to use two or more types of polymers to make Tg fall in the above range. Namely, even if a polymer has a Tg outside the above range, it is preferred that the weight-average Tg thereof is within the range mentioned above.

1) Preferred Polymer Latex Used for the Invention

The preferred polymer latex used for the present invention is latex having a functional group reacting with isocyanate group. Any polymer latex having one or plural kinds selected from the group consisting of these can be used without any limitation.

Examples of the functional group which reacts with isocyanate group incorporated in the polymer latex mentioned above include a carboxy group or a salt thereof, a thiol group, a phenolic hydroxy group, a carboxylic anhydride group, an epoxy group, an amide group, an aromatic amino group, and the like, and combinations thereof. From the standpoint of the reactivity with the isocyanate group, a carboxy group or a salt thereof and a carboxylic anhydride group are preferred, and from the standpoint of the reactivity, particularly preferred is a carboxy group. The amount of functional group is not limited and can be selected arbitrary. However, the functional group may be preferably incorporated in such a ratio that the molecular weight is preferably from 100 to 20,000, and more preferably from 500 to 10,000, per one equivalent weight of functional group. When the amount of functional group is too large, the hardened film is insufficient in the mechanical strength and, water resistance and adhesive property to the substrate tend to degrade, whereas when the amount is too small, film hardening property is poor and durability and water resistance tend to degrade.

Specific examples of the aqueous polymer latex include an aqueous acrylic dispersion, an aqueous vinyl acetate dispersion, an aqueous styrene-butadiene dispersion, a natural rubber latex, and the like. By introducing the functional group (such as a carboxy group, a mercapto group, or the like) which reacts with isocyanate group in the above polymer latex, the resulting polymer latex can be preferably used.

Preferred polymer latex used for the present invention is a polymer latex having a carboxy group or a salt thereof, a thiol group, a phenolic hydroxy group, a carboxylic anhydride group, an epoxy group, an amide group, or an aromatic amino group. Particularly preferred is a polymer latex having a carboxy group or a salt thereof.

2) Specific Examples of Latex

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

LP-1; Latex of —MMA(70) —EA(27) —MAA(3)—(molecular weight 37000, Tg 61° C.)

LP-2; Latex of —MMA(70) —2EHA(20) —St(5) —AA(5)—(molecular weight 40000, Tg 59° C.)

LP-3; Latex of —St(50) —Bu(47) —MAA(3)—(crosslinking, Tg −17° C.)

LP-4; Latex of —St(68) —Bu(29) —AA(3)—(crosslinking, Tg 17° C.)

LP-5; Latex of —St(71) —Bu(26) —AA(3)—(crosslinking, Tg 24° C.)

LP-6; Latex of —St(70) —Bu(27) —IA(3)—(crosslinking)

LP-7; Latex of —St(75) —Bu(24) —AA(I)—(crosslinking, Tg 29° C.)

LP-8; Latex of —St(60) —Bu(35) —DVB(3) —MAA(2)—(crosslinking)

LP-9; Latex of —St(70) —Bu(25) —DVB(2) —AA(3)—(crosslinking)

LP-10; Latex of —VC(50) —MMA(20) —EA(20) —AN(5) —AA(5)—(molecular weight 80000)

LP-11; Latex of —VDC(85) —MMA(5) —EA(5) —MAA(5)—(molecular weight 67000)

LP-12; Latex of —Et(90) —MAA(10)—(molecular weight 12000)

LP-13; Latex of —St(70) —2EHA(27) —AA(3)—(molecular weight 130000, Tg 43° C.)

LP-14; Latex of —MMA(63) —EA(35) —AA(2)—(molecular weight 33000, Tg 47° C.)

LP-15; Latex of —St(70.5) —Bu(26.5) —AA(3)—(crosslinking, Tg 23° C.)

LP-16; Latex of —St(69.5) —Bu(27.5) —AA(3)—(crosslinking, Tg 20.5° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latex above may be used alone, or may be used by blending two or more kinds depending on needs.

<<Commercially Available Articles>>

As other examples of preferable water-soluble polymer or hydrophobic polymer latex, which can be used in the present invention, commercially available aqueous resins described below are usable. As specific examples of commercially available aqueous resins, there can be mentioned water-soluble acrylic resin such as ACRYSET (trade name, manufactured by Nippon Shokubai Co., Ltd.), AROLON (trade name, manufactured by Nippon Shokubai Co., Ltd.), and the like; water-soluble polyurethane such as HYDRAN (trade name, manufactured by Dainippon Ink and Chemicals, Inc.), BONDICK (trade name, manufactured by Dainippon Ink and Chemicals, Inc.), POIZ (trade name, manufactured by Kao Corp.), SUPERFLEX (trade name, manufactured by Dai-ichi Kogyo Seiyaku Co., Ltd.), NEOLETS (trade name, manufactured by Zeneka Co., Ltd.), and the like; water-soluble polyester such as BAIRONAARU (trade name, manufactured by Toyo Boseki Co., Ltd.), FINETEX (trade name, manufactured by Dainippon Ink and Chemicals, Inc.), and the like; water-dispersible, water-diluting, or water-soluble alkyd resin such as HOLS (trade name, manufactured by Kansai Paint Co., Ltd) and the like; water-dispersible, water-diluting, or water-soluble polyolefin resin such as ISOBAN (trade name, manufactured by Kuraray Isoprene Chemical Co., Ltd.), PRIMACOOL (trade name, manufactured by Dow Chemical Ltd.), HITEC (trade name, manufactured by Toho Chemical Industry Co., Ltd.), and the like; water-dispersible epoxy resin such as EPICRON (trade name, manufactured by Dainippon Ink and Chemicals, Inc.) and the like; vinyl chloride emulsion; water-dispersible or water-soluble acrylic resins such as JULIMAR, JUNRON, REOJIC, ARONBIS (trade name, all manufactured by Nippon Junyaku Co., Ltd.); and the like, but the invention is not limited in these.

As specific examples of water-dispersible or water-soluble acrylic resin, there can be mentioned Acryset 19E, Acryset 210E, Acryset 260E, Acryset 288E, and Arolon 453 (all manufactured by Nippon Shokubai Co., Ltd.), Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of water-dispersible polyurethane resin, there can be mentioned Sofuranate AE-10 and Sofuranate AE-40 (all manufactured by Nippon Sofuran Kako Co., Ltd.), HYDRAN AP10, 20, 30, and 40, HYDRAN HW-110, HYDRAN HW-135, HYDRAN HW-320, ECOS-3000, BONDICK 2250 and 72070 (all manufactured by Dainippon Ink and Chemicals, Inc.), Poiz 710 and Poiz 720 (all manufactured by Kao Corp.), Mercy 525, Mercy 585, Mercy 414, and Mercy 455 (all manufactured by Toyo Polymer Co., Ltd.), and the like; as examples of water-dispersible polyester, there can be mentioned BAIRONAARU MD-1200, BAIRONAARU MD-1400, and BAIRONAARU MD-1930 (all manufactured by Toyo Boseki Co., Ltd.), WD-size, WMS, WD3652, WJL6342 (all manufactured by Eastman Chemical Co.), FINETEX ES650, 611, 675, and 850 (all manufactured by Dainippon Ink and Chemicals, Inc.), and the like; as examples of water-soluble, water-diluting, or water-dispersible polyolefin resin, there can be mentioned Isoban-10, Isoban-06, and Isoban-04 Kuraray Isoprene Chemical Co., Ltd.), Primacool 5981, Primacool 5983, Primacool 5990, and Primacool 5991 (all manufactured by Dow Chemical Ltd.), Chemipearl S120 and SA100 (all manufactured by Mitsui Petrochemical Industries, Ltd.), and the like; as examples of water-dispersible or water-soluble acrlylic resin, there can be mentioned Julimar AC-103, 10S, AT-510, ET-410, SEK-301, FC-60, SP-50TF, SPO-602, and AC-70N (all manufactured by Nippon Junyaku Co., Ltd.) and the like; as examples of water-dispersible rubbers, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of water-dispersible poly(vinyl chlorides), there can be mentioned G351 and G576 (all manufactured by Nippon Zeon Co., Ltd.), and the like; as examples of water-dispersible poly(vinylidene chlorides), there can be mentioned L502 and L513 (all manufactured by Asahi Chemical Industry Co., Ltd.), and the like.

3) Binder Which Can Be Used in Combination

In the outermost layer, the water-soluble polymer mentioned above can be used in combination with the above-described latex depending on needs. Particularly among these, a binder which gelates when temperature becomes low (described below in the explanation of the layer adjacent to the outermost layer) is preferably used.

4) Auxiliary Film-Forming Agent Which Can Be Used in Combination

To control the minimum film-forming temperature of the aqueous dispersion of a hydrophobic polymer, an auxiliary film-forming agent may be added. The auxiliary film-forming agent is also called a temporally plasticizer and is the compound (usually an organic solvent) which makes a minimum film-forming temperature of polymer latex decrease and for instance, is described in the above "GOUSEI LATEX NO KAGAKU" (Soichi Muroi, published by Kobunshi Kankokai (1970)). Preferred auxiliary film-forming agents are the following compounds, but the compound usable in the present invention is not limited in the following specific examples.

Z-1; Benzyl alcohol,

Z-2; 2,2,4-Trimethylpentanediol-1,3-monoisobutyrate,

Z-3; 2-Dimethylaminoethanol,

Z-4; Diethylene glycol.

5) Addition Amount

The latex polymer is preferably from 3% by weight to 40% by weight, and more preferably from 5% by weight to 30% by weight, with respect to the total coating solution.

The coating amount of the latex polymer is preferably from 0.3 g/m$^2$ to 4.0 g/m$^2$, and more preferably from 0.5 g/m$^2$ to 2.0 g/m$^2$. When the latex polymer is added in the outermost layer on the backside, similar coating amount (per one layer) is preferred.

3-3. Various Additives Used for Non-Photosensitive Layer

The non-photosensitive layer of the present invention may include various additives such as a matting agent, a hardener, a fluorocarbon surfactant, a delustering agent, a filter dye, and the like. These additives, which also can be used for the other layers, are explained in detail hereinafter.

The matting agent is preferably added in the outermost non-photosensitive layer, but if necessary, the matting agent can be also added in either of the layers disposed closer from the support than the outermost layer. The surface protective layer including the outermost layer may be composed of two or more layers if necessary. By adding various additives such as an additive concerning the development, a surface pH controlling agent, a charge moderator, an ultraviolet absorbing agent, a lubricant, a surfactant, or the like separately into the plural layers, the coexistence of favorable properties for the production such as coating ability and good image quality can be attained.

4. Organic Silver Salt

1) Composition

The organic silver salt which can be used in the present invention is relatively stable to light but serves as to supply silver ions and forms silver images when heated to 80° C. or higher under the presence of an exposed photosensitive silver halide and a reducing agent. The organic silver salt may be any material containing a source capable of supplying silver ions that are reducible by a reducing agent. Such a non-photosensitive organic silver salt is disclosed, for example, in JP-A No. 10-62899 (paragraph Nos. 0048 to 0049), EP No. 0803764A1 (page 18, line 24 to page 19, line 37), EP No. 0962812A1, JP-A Nos. 11-349591, 2000-7683, and 2000-72711, and the like. A silver salt of an organic acid, particularly, a silver salt of a long chained aliphatic carboxylic acid (having 10 to 30 carbon atoms, and preferably having 15 to 28 carbon atoms) is preferable. Preferred examples of the silver salt of a fatty acid can include, for example, silver lignocerate, silver behenate, silver arachidinate, silver stearate, silver oleate, silver laurate, silver caprionate, silver myristate, silver palmitate, silver erucate, and mixtures thereof. In the present invention, among these silver salts of a fatty acid, it is preferred to use a silver salt of a fatty acid with a silver behenate content of 50 mol % or higher, more preferably, 90 mol % or higher, and even more preferably, 95 mol % or higher. Further, it is preferred to use a silver salt of a fatty acid with a silver erucate content of 2 mol % or lower, more preferably, 1 mol % or lower, and even more preferably, 0.1 mol % or lower.

2) Shape

There is no particular restriction on the shape of the organic silver salt usable in the invention and it may be needle-like, bar-like, tabular, or flake shaped.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, even more preferably, 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, even more preferably, 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be prepared by mixing an aqueous dispersion of the organic silver salt and an aqueous dispersion of a photosensitive silver salt and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably, from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing is used preferably for controlling photographic properties.

4) Addition Amount

While the organic silver salt according to the invention can be used in a desired amount, a total amount of coated silver including silver halide is preferably in a range of from 0.1 g/m$^2$ to 5.0 g/m$^2$, more preferably from 0.3 g/m$^2$ to 3.0 g/m$^2$, and even more preferably from 0.5 g/m$^2$ to 2.0 g/m$^2$. In particular, in order to improve image storability, the total amount of coated silver is preferably 1.8 mg/m$^2$ or less, and more preferably 1.6 mg/m$^2$ or less.

5. Reducing Agent

The photothermographic material of the present invention preferably contains a reducing agent for organic silver salts as a thermal developing agent. The reducing agent for organic silver salts can be any substance (preferably, organic substance) which reduces silver ions into metallic silver. Examples of the reducing agent are described in JP-A No. 11-65021 (column Nos. 0043 to 0045) and EP No. 0803764 (p. 7, line 34 to p. 18, line 12).

The reducing agent according to the invention is preferably a so-called hindered phenolic reducing agent or a bisphenol agent having a substituent at the ortho-position to the phenolic hydroxy group. It is more preferably a reducing agent represented by the following formula (R).

Formula (R)

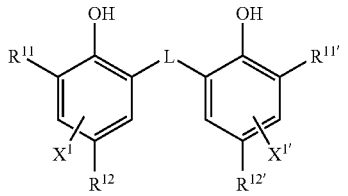

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a group capable of substituting for a hydrogen atom on a benzene ring. $X^1$ and $X^{1'}$ each independently represent a hydrogen atom or a group capable of substituting for a hydrogen atom on a benzene ring. As each of the groups capable of substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group can include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a secondary or tertiary alkyl group having 3 to 15 carbon atoms and can include, specifically, an isopropyl group, an isobutyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, a tertiary alkyl group having 4 to 12 carbon atoms and, among them, a t-butyl group, a t-amyl group, and a 1-methylcyclohexyl group are further preferred and, a t-butyl group being most preferred.

$R^{12}$ and $R^{12'}$ are preferably an alkyl group having 1 to 20 carbon atoms and can include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group.

$X^1$ and $X^{1'}$ are preferably a hydrogen atom, a halogen atom, or an alkyl group, and more preferably, a hydrogen atom.

L is preferably a —$CHR^{13}$— group.

$R^{13}$ is preferably a hydrogen atom or an alkyl group having 1 to 15 carbon atoms. Preferable examples of the alkyl group can include a methyl group, an ethyl group, a propyl group, an isopropyl group, and a 2,4,4-trimethylpentyl group. Particularly preferable $R^{13}$ is a hydrogen atom, a methyl group, an ethyl group, a propyl group, or an isopropyl group.

When $R^{13}$ is a hydrogen atom, $R^{12}$ and $R^{12'}$ are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$ and $R^{12'}$ are preferably a methyl group. The primary or secondary alkyl group having 1 to 8 carbon atoms as $R^{13}$ is preferably a methyl group, an ethyl group, a propyl group, or an isopropyl group, and more preferably a methyl group, an ethyl group, or a propyl group.

When all of $R^{11}$, $R^{11'}$, $R^{12}$ and $R^{12'}$ are a methyl group, $R^{13}$ is preferably a secondary alkyl group. In this case, the secondary alkyl group as $R^{13}$ is preferably an isopropyl group, an isobutyl group, or a 1-ethylpentyl group, and more preferably an isopropyl group.

The reducing agent described above shows different thermal developing performances, color tones of developed silver images, or the like depending on the combination of $R^{11}$, $R^{11'}$, $R^{12}$, $R^{12'}$, and $R^{13}$. Since these performances can be controlled by using two or more reducing agents in combination, it is preferred to use two or more reducing agents in combination depending on the purpose.

Specific examples of the reducing agents of the invention including the compounds represented by formula (R) according to the invention are shown below, but the invention is not restricted to these.

R-1

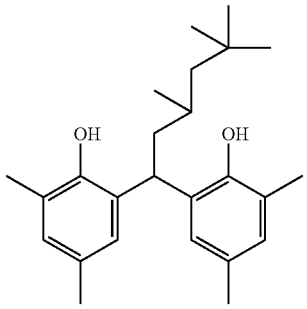

R-2

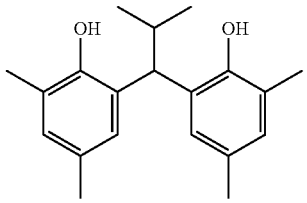

R-3

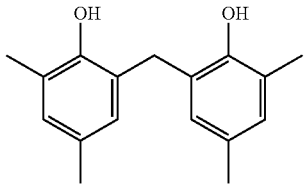

R-4

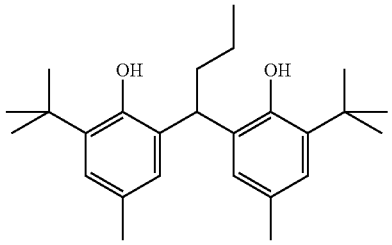

R-5

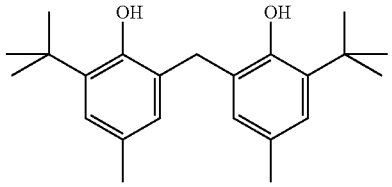

R-6

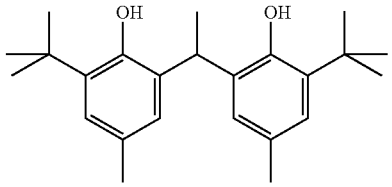

-continued
R-7
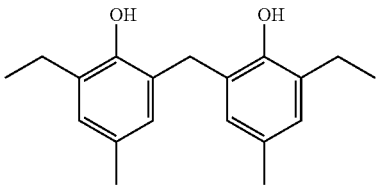
R-8
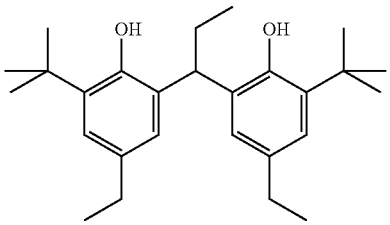
R-9
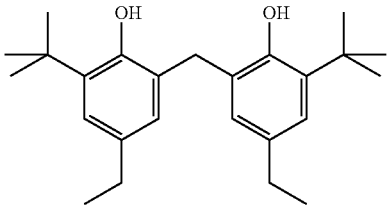
R-10
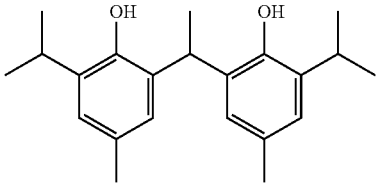
R-11
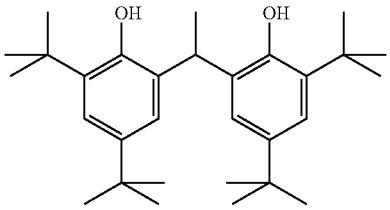
R-12
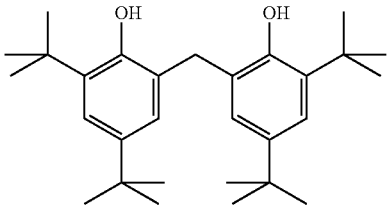
R-13
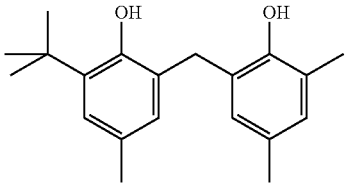
-continued
R-14
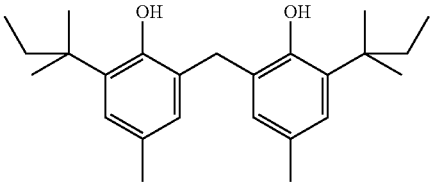
R-15
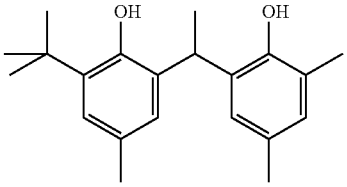
R-16
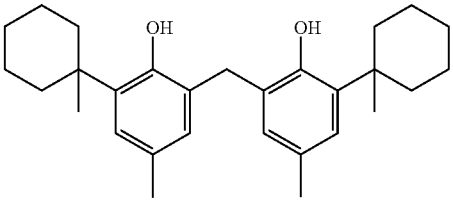
R-17
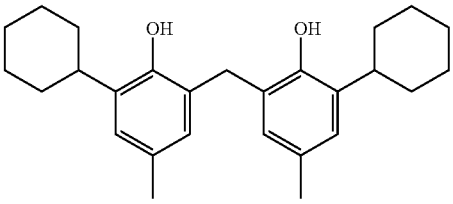
R-18
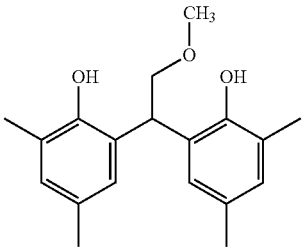
R-19
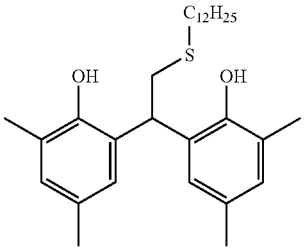
R-20
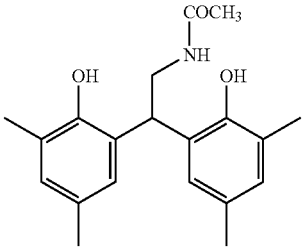

-continued
R-21
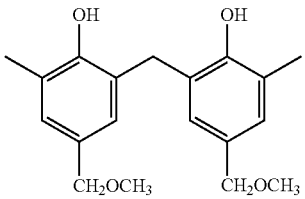
R-22
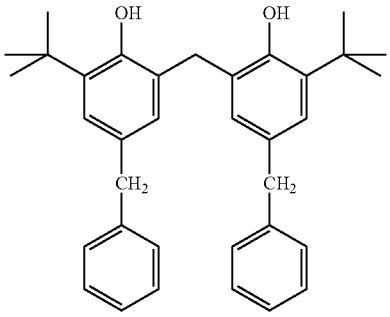
R-23
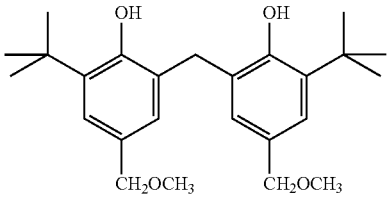
R-24
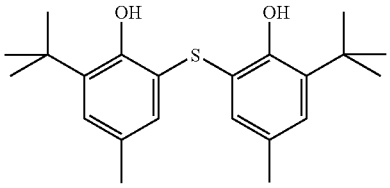
R-25
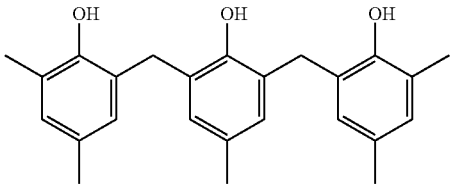
R-26
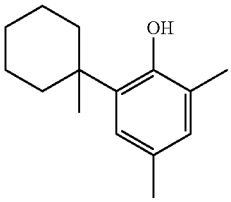
R-27
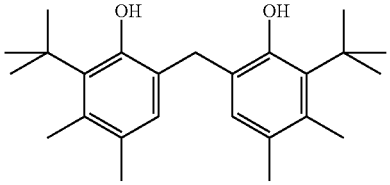
-continued
R-28
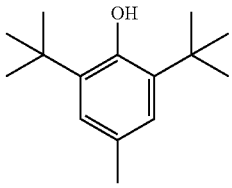
R-29
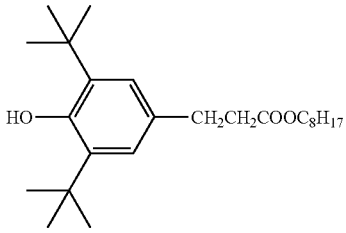
R-30
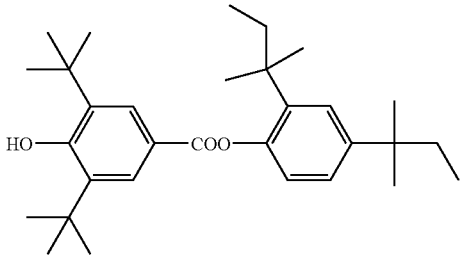
R-31
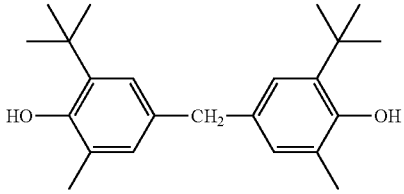
R-32
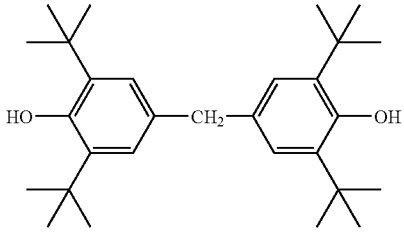
R-33
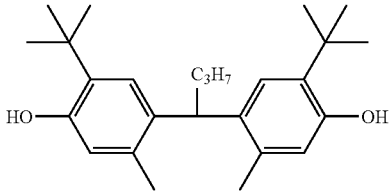
R-34
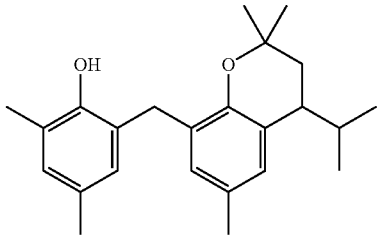

As preferred reducing agents of the invention other than those above, there can be mentioned compounds disclosed in JP-A Nos. 2001 -188314, 2001-209145, 2001-350235, and 2002-156727.

The addition amount of the reducing agent is preferably from 0.1 g/m$^2$ to 3.0 g/m$^2$, more preferably from 0.2 g/m$^2$ to 1.5 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into a photothermographic material by being added into the coating solution, such as in the form of a solution, an emulsified dispersion, a solid fine particle dispersion, or the like.

As well known emulsified dispersing method, there can be mentioned a method comprising dissolving the reducing agent in an oil such as dibutylphthalate, tricresylphosphate, glyceryl triacetate, diethylphthalate, or the like, and an auxiliary solvent such as ethyl acetate, cyclohexanone, or the like, followed by mechanically forming an emulsified dispersion.

As a solid particle dispersing method, there can be mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as solid particle dispersion, and is added in the form of fine particles having average particle size of from 0.01 μm to 10 μm, preferably from 0.05 μm to 5 μm and, more preferably from 0.1 μm to 2 μm. In the invention, other solid dispersions are preferably used with this particle size range.

6. Compound Represented by Formula (P)

In the present invention, it is preferred that the photothermographic material contains a compound represented by the following formula (P).

Formula (P)

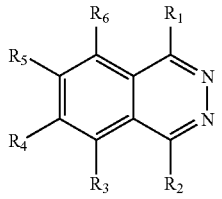

In formula (P), $R_1$ to $R_6$ each independently represent a hydrogen atom or a substituent. The substituent represented by $R_1$ to $R_6$ may be any substituent as far as it does not give a bad effect toward photographic properties. Examples of such substituents include a halogen atom (for example, fluorine atom, chlorine atom, bromine atom, and iodine atom); a linear, branched, or cyclic alkyl group (preferably having 1 to 20 carbon atoms, more preferably 1 to 16 carbon atoms, and particularly preferably 1 to 12 carbon atoms, for example, methyl, ethyl, isopropyl, tert-butyl, tert-octyl, tert-amyl, cyclohexyl, and the like); an alkenyl group (preferably having 2 to 20 carbon atoms, more preferably 2 to 16 carbon atoms, and particularly preferably 2 to 12 carbon atoms, for example, vinyl, allyl, 2-butenyl, 3-pentenyl, and the like); an aryl group (preferably having 6 to 30 carbon atoms, more preferably 6 to 20 carbon atoms, and particularly preferably 6 to 12 carbon atoms, for example, phenyl, p-methyl phenyl, naphthyl, and the like); an alkoxy group (preferably having 1 to 20 carbon atoms, more preferably 1 to 16 carbon atoms, and particularly preferably 1 to 12 carbon atoms, for example, methoxy, ethoxy, butoxy, and the like); an aryloxy group (preferably having 6 to 30 carbon atoms, more preferably 6 to 20 carbon atoms, and particularly preferably 6 to 12 carbon atoms, for example, phenyloxy, 2-naphtyloxy group, and the like); an acyloxy group (preferably having 1 to 20 carbon atoms, more preferably 2 to 16 carbon atoms, and particularly preferably 2 to 12 carbon atoms, for example, acetoxy, benzoyloxy, and the like); an amino group (preferably having 0 to 20 carbon atoms, more preferably 2 to 16 carbon atoms, and particularly preferably 2 to 12 carbon atoms, for example, a dimethyamino group, a diethylamino group, a dibutylamio group, and the like); an acylamino group (preferably having 1 to 20 carbon atoms, more preferably 2 to 16 carbon atoms, and particularly preferably 2 to 12 carbon atoms, for example, acetylamino, benzoylamino, and the like); a sulfonylamino group (preferably having 1 to 20 carbon atoms, more preferably 1 to 16 carbon atoms, and particularly preferably 1 to 12 carbon atoms, for example, methanesufonylamino, benzenesulfonylamino and the like); a ureido group (preferably having 1 to 20 carbon atoms, more preferably 1 to 16 carbon atoms, and particularly preferably 1 to 12 carbon atoms, for example, ureido, methylureido, phenylureido, and the like); a carbamate group (preferably having 2 to 20 carbon atoms, more preferably 2 to 16 carbon atoms, and particularly preferably 2 to 12 carbon atoms, for example, methoxycarbonylamino, phenyloxycarbonylamino group, and the like); a carboxyl group; a carbamoyl group (preferably having 1 to 20 carbon atoms, more preferably 1 to 16 carbon atoms, and particularly preferably 1 to 12 carbon atoms, for example, carbamoyl, N,N-diethylcarbamoyl, N-phenylcarbamoyl, and the like); an alkoxycarbonyl group (preferably having 2 to 20 carbon atoms, more preferably 2 to 16 carbon atoms, and particularly preferably 2 to 12 carbon atoms, for example, methoxycarbonyl, ethoxycarbonyl, and the like); an acyl group (preferably having 2 to 20 carbon atoms, more preferably 2 to 16 carbon atoms, and particularly preferably 2 to 12 carbon atoms, for example, acetyl, benzoyl, formyl, pivaloyl, and the like); a sulfo group; a sulfonyl group (preferably having 1 to 20 carbon atoms, more preferably 1 to 16 carbon atoms, and particularly preferably 1 to 12 carbon atoms, for example, mesyl, tosyl, and the like); a sulfamoyl group (preferably having 0 to 20 carbon atoms, more preferably 0 to 16 carbon atoms, and particularly preferably 0 to 12 carbon atoms, for example, sulfamoyl, methylsulfamoyl, dimethylsulfamoyl, phenylsulfamoyl, and the like); a cyano group; a nitro group; a hydroxy group; a mercapto group; an alkylthio group (preferably having 1 to 20 carbon atoms, more preferably 1 to 16 carbon atoms, and particularly preferably 1 to 12 carbon atoms, for example, methylthio, butylthio, and the like); and a heterocyclic group (preferably having 2 to 20 carbon atoms, more preferably 2 to 16 carbon atoms, and particularly preferably 2 to 12 carbon atoms, for example, pyridyl, imidazolyl, pyrrolydyl, and the like).

The substituents represented by $R_1$ to $R_6$ are preferably a halogen atom, a linear, branched, or cyclic alkyl group, an aryl group, an alkoxy group, an aryloxy group, a cyano group, a nitro group, a hydroxy group, a mercapto group, an alkylthio group, an acylamino group, a carbamoyl group, an alkoxycarbonyl group, or an acyloxy group. More preferred is a linear, branched, or cyclic alkyl group, an alkoxy group, or an aryloxy group, and particularly preferred is a linear or branched alkyl group.

$R_1$ and $R_2$ are preferably a hydrogen atom. At least one of $R_3$ and $R_4$ is preferably a substituent other than a hydrogen atom. $R_1$ to $R_6$ preferably have 0 to 16 carbon atoms in total, more preferably 1 to 8 carbon atoms, and further preferably 2 to 6 carbon atoms in total. Particularly preferred embodiment is the structure where $R_6$ is an alkyl group and the others besides $R_6$ are all hydrogen atoms. In the above case, the alkyl group is preferably a linear or branched alkyl group having 1 to 6 carbon atoms, and most preferably 2 to 4 carbon atoms.

The substituents represented by $R_1$ to $R_6$ may be the same or different from one another. These substituents may further be substituted by another substituent. Moreover, they may bond to each other to form a cyclic structure.

The compound represented by formula (P) preferably has a melting point of 140° C. or less. The compound which has a liquid state at room temperature (the temperature of about 15° C.) is also included.

P-1

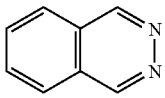

P-2

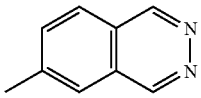

P-3

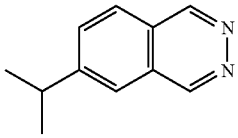

P-4

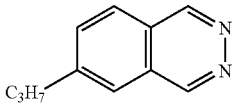

P-5

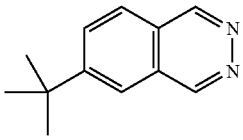

-continued

P-6

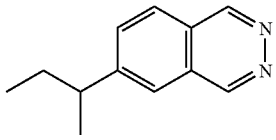

P-7

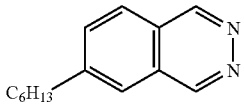

P-8

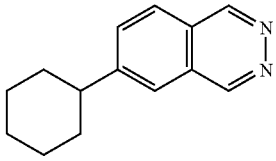

P-9

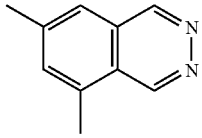

P-10

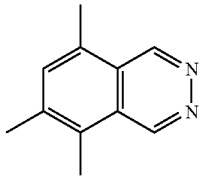

P-11

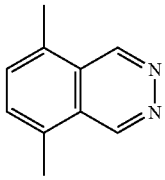

P-12

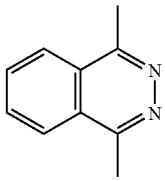

P-13

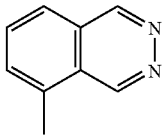

P-14

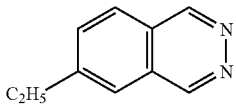

P-15

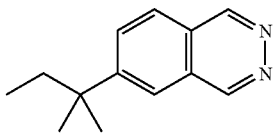

-continued
P-16
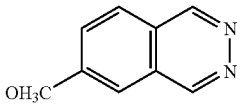
P-17
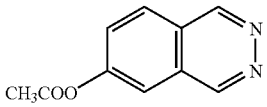
P-18
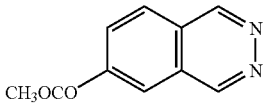
P-19
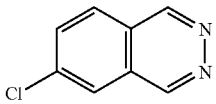
P-20
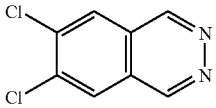
P-21
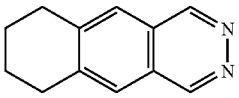
P-22
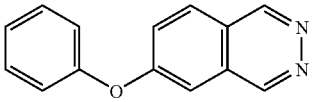
P-23
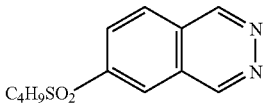
P-24
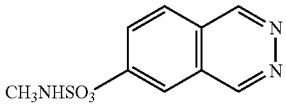
P-25
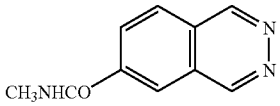
P-26
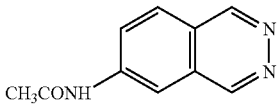
P-27
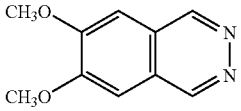
P-28
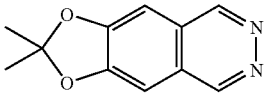
-continued
P-29
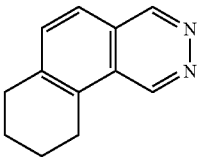
P-30
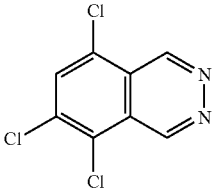
P-31
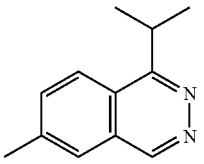
P-32
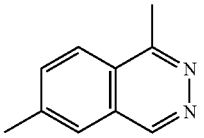
P-33
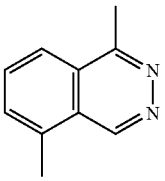
P-34
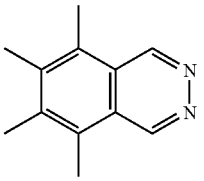
P-35
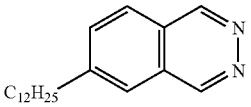
P-36
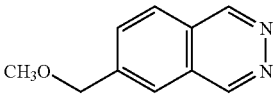
P-37
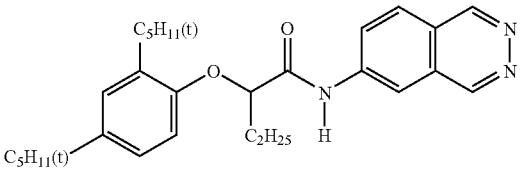
The compound represented by formula (P) according to the present invention can be added to any layer of the photothermographic material, but it is preferred to add it to at least one layer of the image forming layer and the layer adjacent to the image forming layer, and it is more preferred to add it to the image forming layer. The addition amount of the compound represented by formula (P) according to the present invention differs largely dependent on its specific structure, combination with many other components to be added, and the like, but is from 0.001 mol to 1 mol, preferably from 0.01 mol to 0.5 mol, and more preferably from 0.02 mol to 0.2 mol, per 1 mol of silver.

The compound represented by formula (P) according to the present invention can be incorporated into the photothermographic material by introducing methods similar to those for the reducing agent. It is preferably added by forming a solid fine particle dispersion in a fine particle state.

7. Development Accelerator

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (I) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable. The development accelerator described above is used in a range of from 0.1 mol % to 20 mol %, preferably, in a range of from 0.5 mol % to 10 mol % and, more preferably in a range of from 1 mol % to 5 mol %, with respect to the reducing agent. The introducing methods to the photothermographic material can include similar methods as those for the reducing agent and, it is particularly preferred to add as a solid dispersion or an emulsified dispersion. In the case of adding as an emulsified dispersion, it is preferred to add as an emulsified dispersion dispersed by using a high boiling solvent which is solid at a normal temperature and an auxiliary solvent at a low boiling point, or to add as a so-called oilless emulsified dispersion not using the high boiling solvent.

In the present invention, among the development accelerators described above, hydrazine compounds represented by formula (D) described in the specification of JP-A No. 2002-156727, and phenolic or naphtholic compounds represented by formula (2) described in the specification of JP-A No. 2001-264929 are more preferred.

Particularly preferred development accelerators of the invention are compounds represented by the following formulae (A-1) or (A-2).

$$Q_1—NHNH—Q_2 \qquad \text{Formula (A-1)}$$

In the formula, $Q_1$ represents an aromatic group or a heterocyclic group which bonds to —NHNH—$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in a case where they have two or more substituents, the substituents may be identical or different from each other. Examples of the substituents can include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents can include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms and, more preferably having 6 to 40 carbon atoms, and examples can include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl) carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, and N-benzylcarbamoyl.

The acyl group represented by $Q_2$ is an acyl group, preferably having 1 to 50 carbon atoms and, more preferably having 6 to 40 carbon atoms, and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group, preferably having 2 to 50 carbon atoms and, more preferably having 6 to 40 carbon atoms, and can include, for example, methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group, preferably having 7 to 50 carbon atoms and, more preferably having 7 to 40 carbon atoms, and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group, preferably having 0 to 50 carbon atoms, more preferably having 6 to 40 carbon atoms, and can include, for example, unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, those substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated hetero ring are more preferred. Further, $Q_2$ is preferably a carbamoyl group and particularly, a carbamoyl group having a hydrogen atom on the nitrogen atom is preferred.

Formula (A-2)

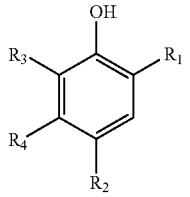

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group capable of substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A-1

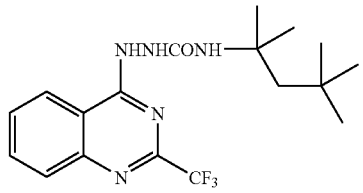

A-2

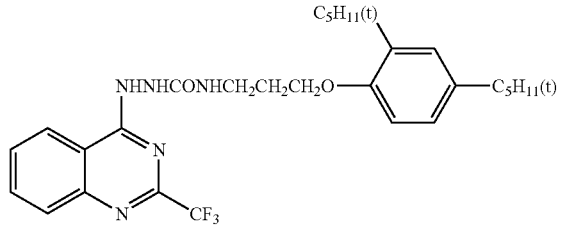

A-3

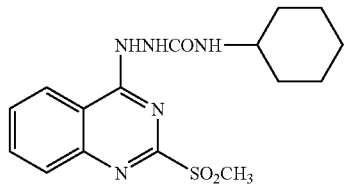

A-4

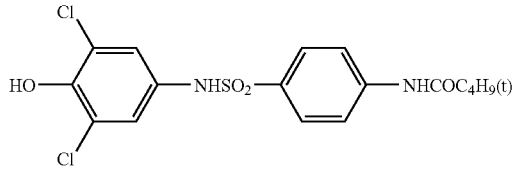

A-5

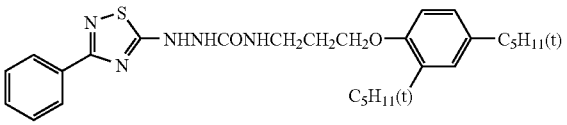

-continued

A-6

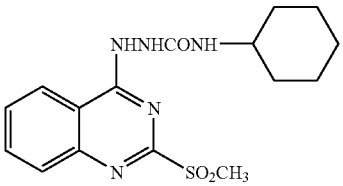

A-7

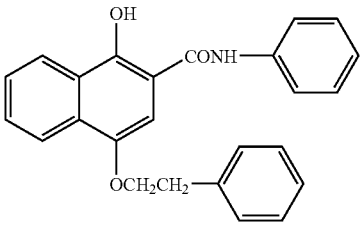

A-8

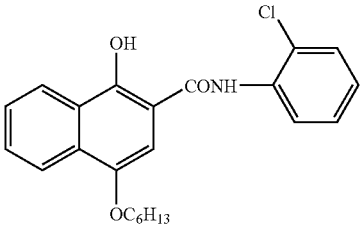

A-9

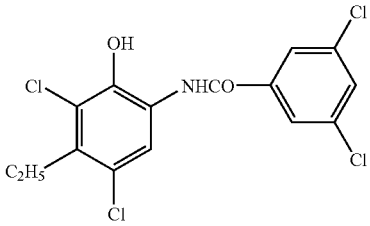

A-10

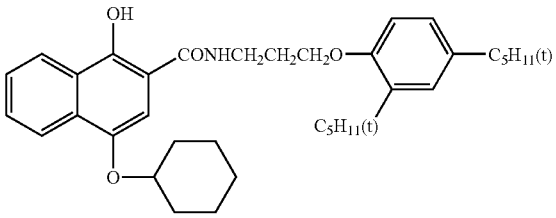

8. Hydrogen Bonding Compound

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxy group or an amino group, there can be mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having >N—H moiety but being blocked in the form of >N—Ra (where, Ra represents a substituent other than H)), a urethane group (not having >N—H moiety but being blocked in the form of >N—Ra (where, Ra represents a substituent other than H)), and a ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

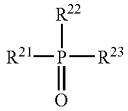

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of an alkyl group expressed by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As an aryl group, there can be mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As an alkoxy group, there can be mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As an aryloxy group, there can be mentioned a phenoxy group, a cresyloxy group, an isopropylphenoxy group, a 4-t-butylphenoxy group, a naphthoxy group, a biphenyloxy group, and the like.

As an amino group, there can be mentioned are a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ is an alkyl group, an aryl group, an alkoxy group, or an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others are shown below, but the invention is not limited thereto.

D-1
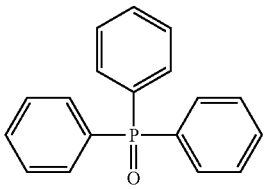
D-2
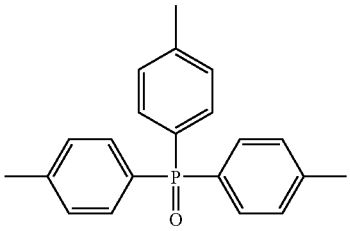
D-3
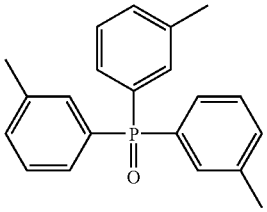
D-4
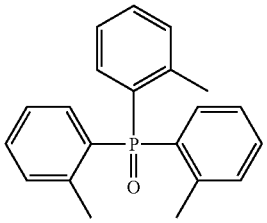
D-5
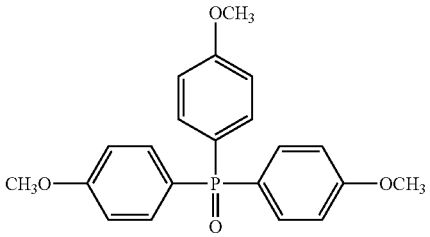
D-6
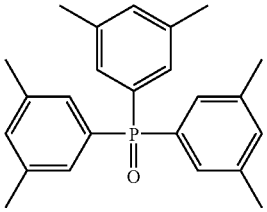
D-7
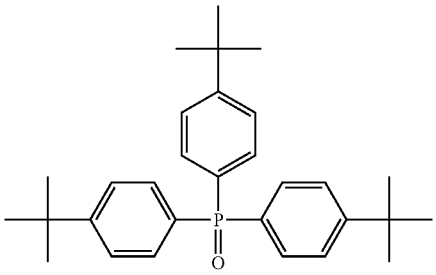
-continued
D-8
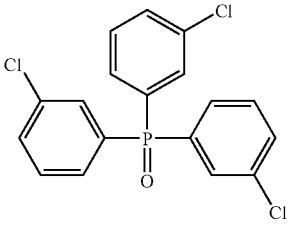
D-9
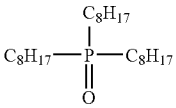
D-10
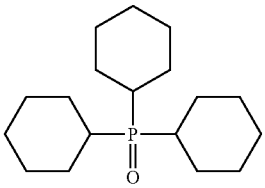
D-11
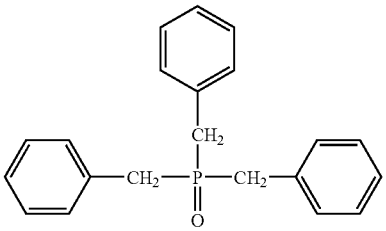
D-12
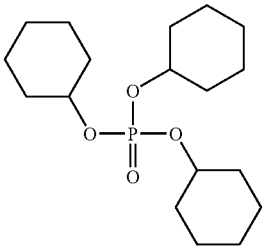
D-13
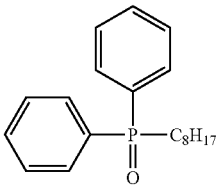
D-14
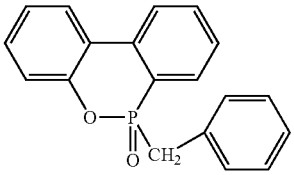
D-15
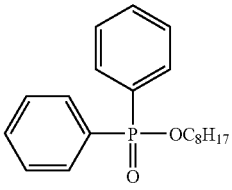

-continued

D-16

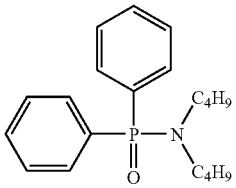

D-17

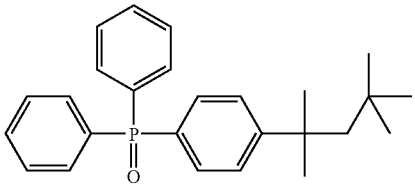

D-18

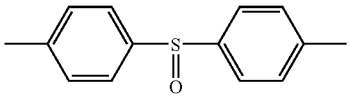

D-19

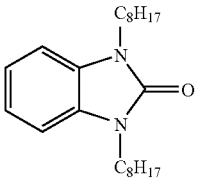

D-20

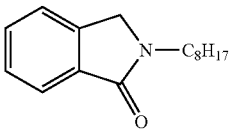

D-21

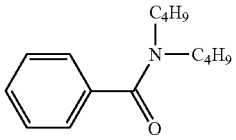

Specific examples of the hydrogen bonding compound other than those enumerated above can be found in those described in EP No. 1,096,310 and in JP-A Nos. 2002-156727 and 2002-318431.

The compound expressed by formula (D) used in the invention can be used in the photothermographic material by being incorporated into the coating solution in the form of solution, emulsified dispersion, or solid fine particle dispersion, similar to the case of reducing agent. However, it is preferably used in the form of solid dispersion. In the solution, the compound expressed by formula (D) forms a hydrogen-bonded complex with a compound having a phenolic hydroxy group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in a range from 1 mol % to, 200 mol %, more preferably from 10 mol % to 150 mol %, and even more preferably, from 20 mol % to 100 mol %, with respect to the reducing agent.

9. Photosensitive Silver Halide

1) Halogen Composition

For the photosensitive silver halide used in the invention, there is no particular restriction on the halogen composition and silver chloride, silver bromochloride, silver bromide, silver iodobromide, silver iodochlorobromide, and silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, in a range of from 0.01 μm to 0.15 μm and, even more preferably, from 0.02 μm to 0.12 μm. The grain size as used herein means an average diameter of a circle converted such that it has a same area as a projected area of the silver halide grain (projected area of a major plane in a case of a tabular grain).

4) Grain Shape

The shape of the silver halide grain can include, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably, 65% or higher and, even more preferably, 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18).

Preferred are metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more kinds of complexes comprising identical or different species of metals may be used together. A preferred content is in a range from $1\times10^{-9}$ mol to $1\times10^{-3}$ mol per 1 mol of silver. The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl) ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained in the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to the spectral characteristic of an exposure light source can be advantageously selected. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 0803764A1, and in JP-A Nos. 2001-272747, 2001-290238 and 2002-23306. The sensitizing dyes described above may be used alone or two or more of them may be used in combination. In the invention, sensitizing dye can be added preferably after a desalting step and before coating, and more preferably after a desalting step and before the completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just before coating, or the like.

The amount of sulfur, selenium, or tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just before coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that can be one-electron-oxidized to provide a one-electron oxidation product which releases one or more electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is preferably a compound selected from the following Groups 1 or 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation reaction.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5747235 and 5747236; EP No. 786692A1 (Compound INV 1 to 35); EP No. 893732A1; U.S. Pat. Nos. 6054260 and 5994051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). And the preferable ranges of these compounds are the same as the preferable ranges described in the quoted specifications.

Formula (1)

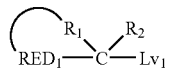

Formula (2)

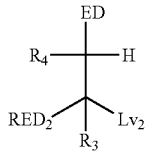

In formulae (1) and (2), $RED_1$ and $RED_2$ each independently represent a reducing group. $R_1$ represents a nonmetallic atomic group forming a cyclic structure equivalent to a tetrahydro derivative or an octahydro derivative of a 5- or 6-membered aromatic ring (including a hetero aromatic ring) with a carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

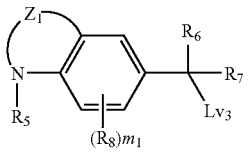

Formula (4)

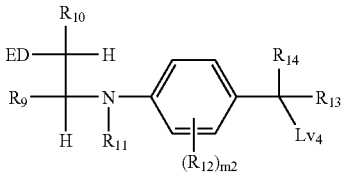

Formula (5)

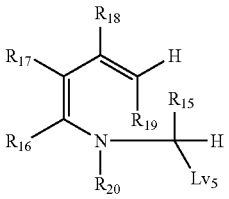

In formulae (3), (4), and (5), $Z_1$ represents an atomic group capable to form a 6-membered ring with a nitrogen atom and two carbon atoms of a benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent, however, in the case where $R_{20}$ represents a group other than an aryl group, $R_{16}$ and $R_{17}$ bond to each other to form an aromatic ring or a hetero aromatic ring. $R_8$ and $R_{12}$ represent a substituent capable of substituting for a hydrogen atom on a benzene ring. $m_1$ represents an integer of 0 to 3, and m2 represents an integer of 0 to 4. $Lv_3$, $Lv_4$, and $Lv_5$ each independently represent a leaving group.

Formula (6)

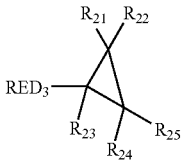

Formula (7)

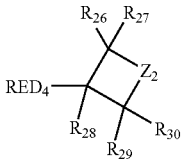

In formulae (6) and (7), $RED_3$ and $RED_4$ each independently represent a reducing group. $R_{21}$ to $R_{30}$ each independently represent a hydrogen atom or a substituent. $Z_2$ represents one selected from —$CR_{111}R_{112}$—, —$NR_{113}$—, or —O—. $R_{111}$ and $R_{112}$ each independently represent a hydrogen atom or a substituent. $R_{113}$ represents one selected from a hydrogen atom, an alkyl group, an aryl group, or a heterocyclic group.

Formula (8)

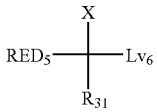

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Reaction formula (1)

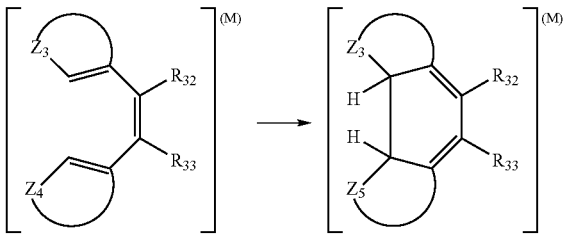

Formula (9)

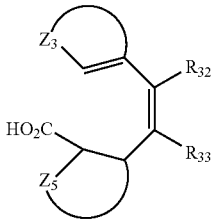

The compound represented by formula (9) is a compound that undergoes a bonding reaction represented by reaction formula (1) after undergoing two-electrons-oxidation accompanied by decarbonization and further oxidized. In reaction formula (1), $R_{32}$ and $R_{33}$ represent a hydrogen atom or a substituent. $Z_3$ represents a group to form a 5- or 6-membered heterocycle with C═C. $Z_4$ represents a group to form a 5- or 6-membered aryl group or heterocyclic group with C═C. M represents one selected from a radical, a radical cation, and a cation. In formula (9), $R_{32}$, $R_{33}$, and $Z_3$ are the same as those in reaction formula (1). $Z_5$ represents a group to form a 5- or 6-membered cyclic aliphatic hydrocarbon group or heterocyclic group with C—C.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which can be one-electron-oxidized. Y represents a reactive group containing a carbon-carbon double bond part, a carbon-carbon triple bond part, an aromatic group part, or benzo-condensed nonaromatic heterocyclic part which can react with one-electron-oxidized product formed by one-electron-oxidation of $RED_6$ to form a new bond. Q represents a linking group to link $RED_6$ and Y.

Reaction formula (1)

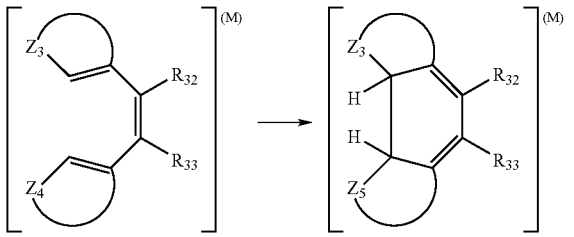

Formula (11)

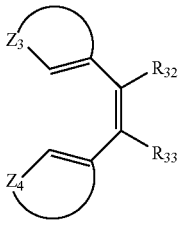

The compound represented by formula (11) is a compound that undergoes a bonding reaction represented by reaction formula (1) by being oxidized. In reaction formula (1), $R_{32}$ and $R_{33}$ each independently represent a hydrogen atom or a substituent. $Z_3$ represents a group to form a 5 or 6-membered heterocycle with C═C. $Z_4$ represents a group to form a 5- or 6-membered aryl group or heterocyclic group with C═C. $Z_5$ represents a group to form a 5- or 6-membered cyclic aliphatic hydrocarbon group or heterocyclic group with C—C. M represents one selected from a radical, a radical cation, and a cation. In formula (11), $R_{32}$, $R_{33}$, $Z_3$, and $Z_4$ are the same as those in reaction formula (1).

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having —NH— group as a partial structure of heterocycle capable to form a silver imidate (>NAg) (e.g., a benzotriazole group, a benzimidazole group, an indazole group, or the like) are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as an adsorptive group. As typical quaternary salt structure of nitrogen, an ammonia group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom can be used. As a quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used. These nitrogen-containing heterocyclic groups containing a quaternary nitrogen atom may have any substituent.

Examples of counter anions of quaternary salt are a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as an adsorptive group is represented by formula (X).

Formula (X)

$$(P—Q_1—)_i—R(—Q_2—S)_j$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

Specific examples of the compound represented by Groups 1 or 2 are shown below, but the invention is not limited to these.

1

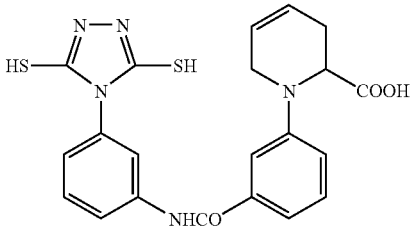

2

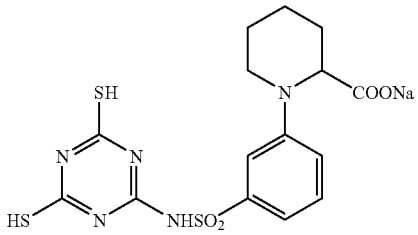

3

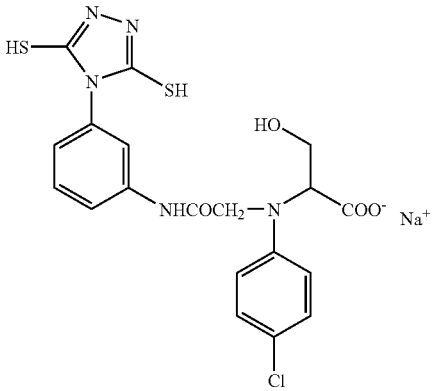

4

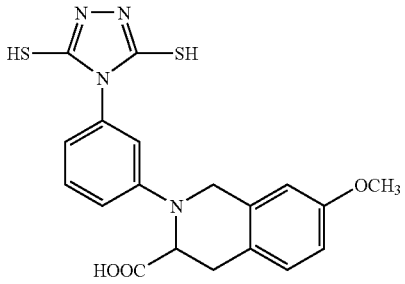

5

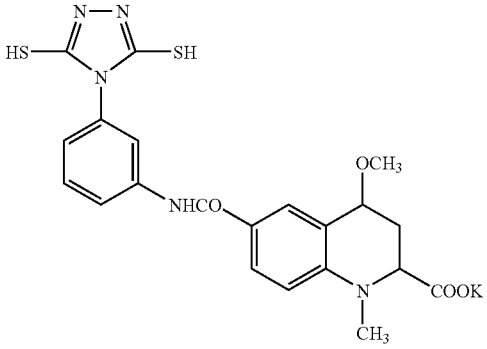

6

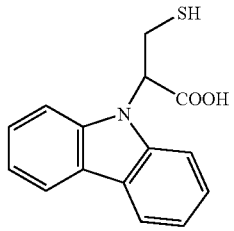

7

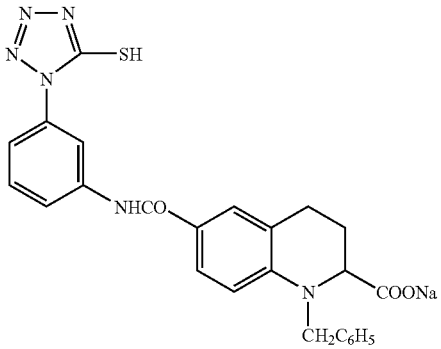

8

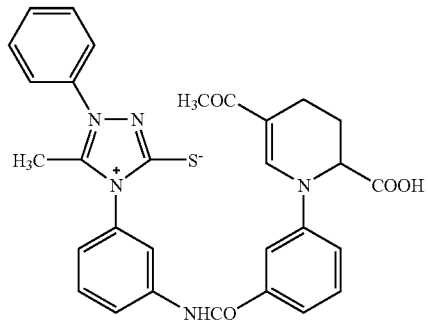

-continued
9
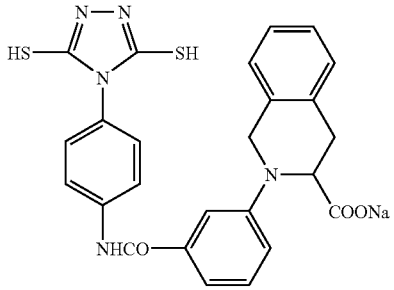
10
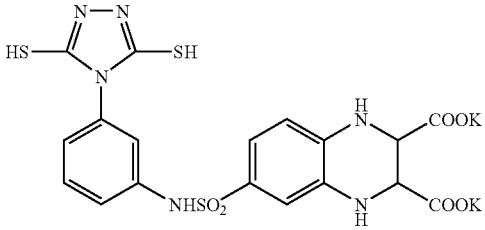
11
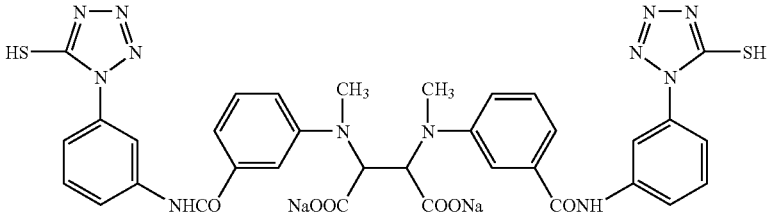
12
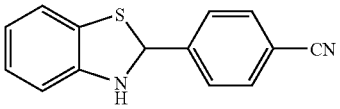
13
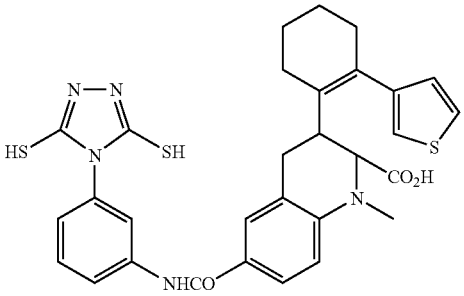
14
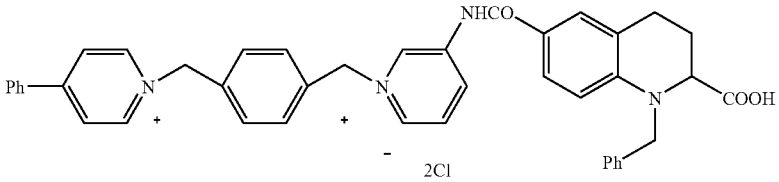
15
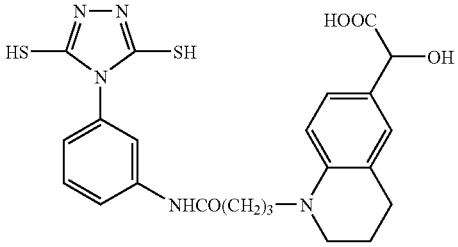
16
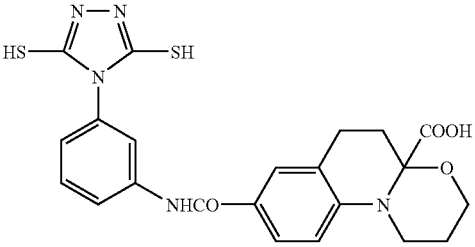
17
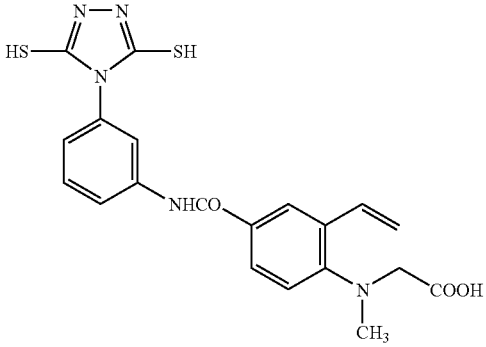

-continued
18
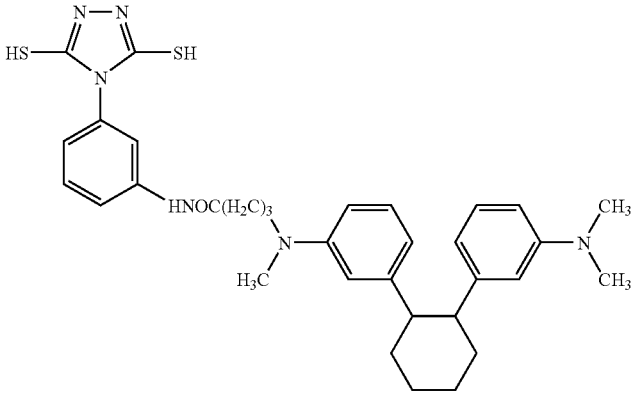
19
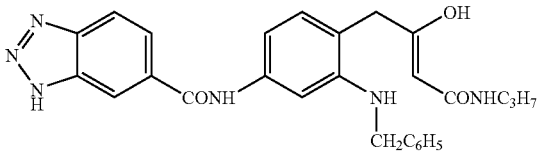
20
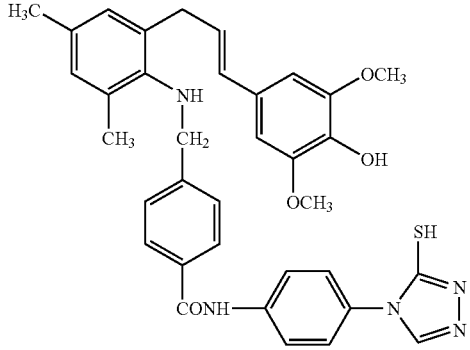
21
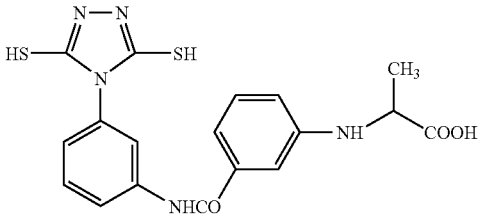
22
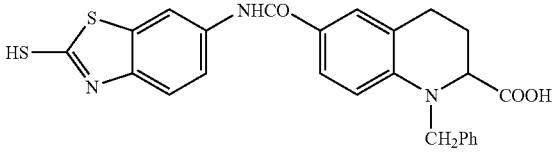
23
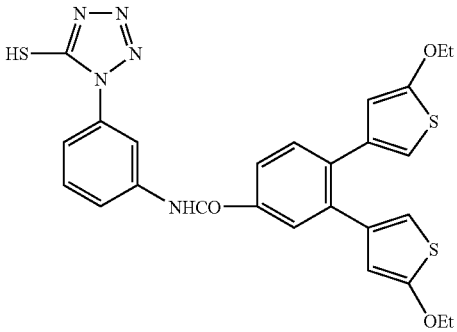

-continued
24
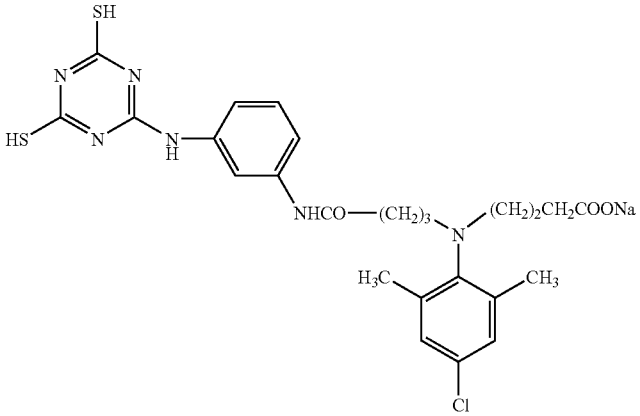
25
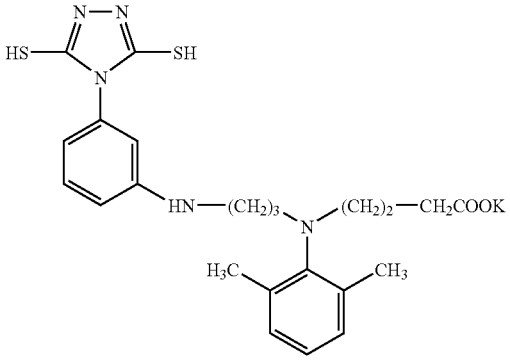
26
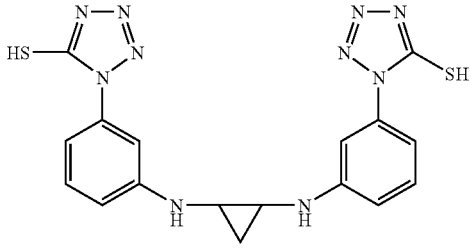
27
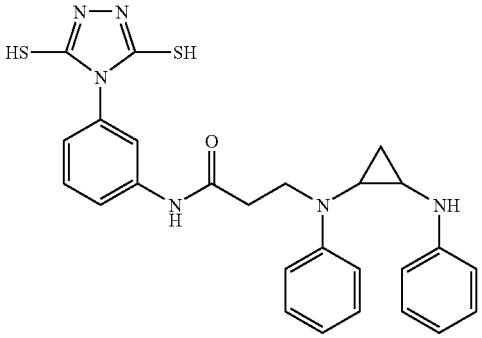
28
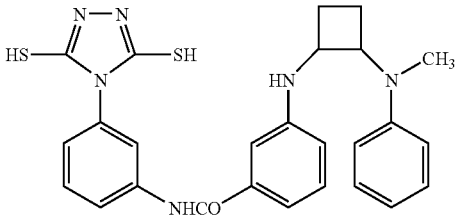
29
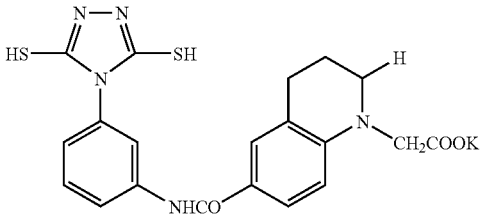
30
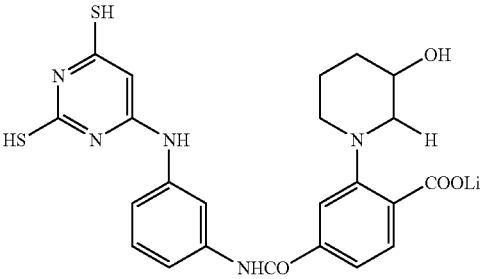

-continued
31
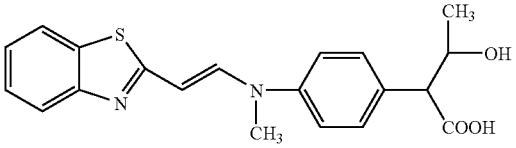
32
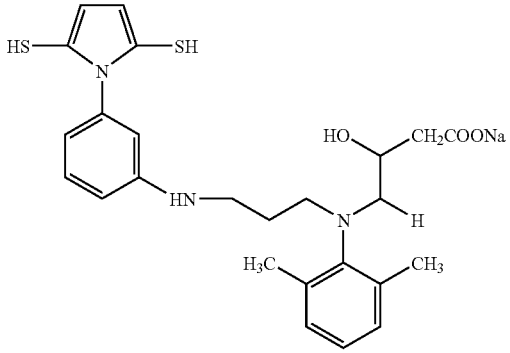
33
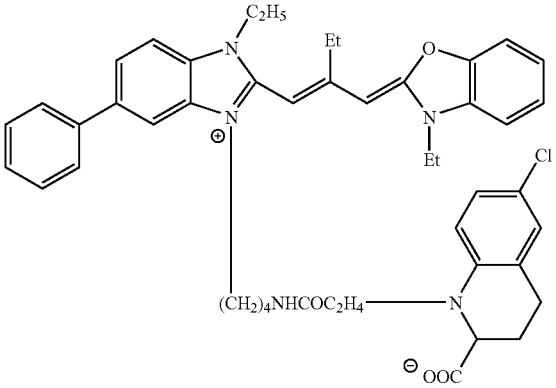
34
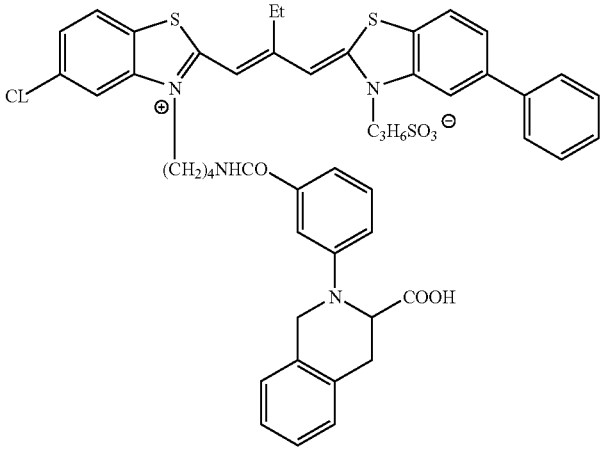
35
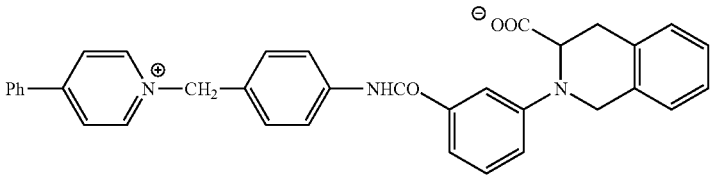
36
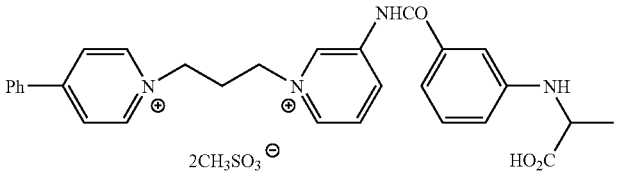

-continued
37
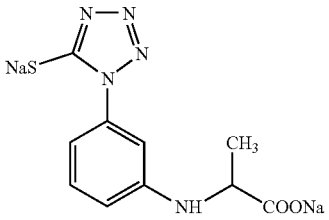
38
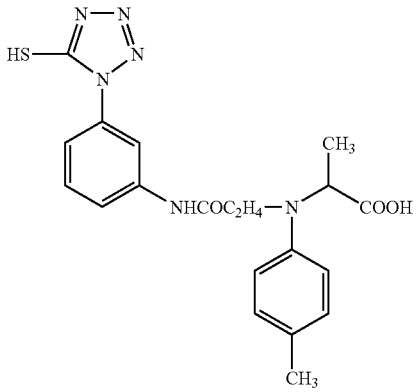
39
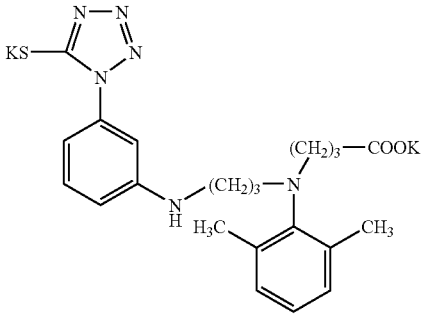
40
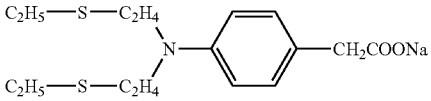
41
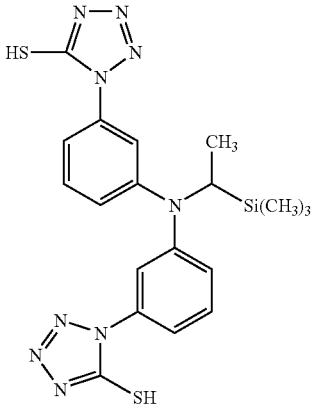
42
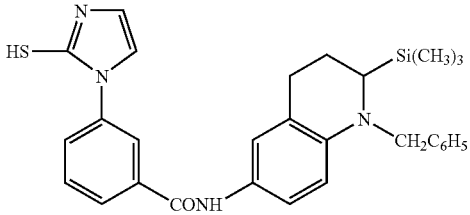
43
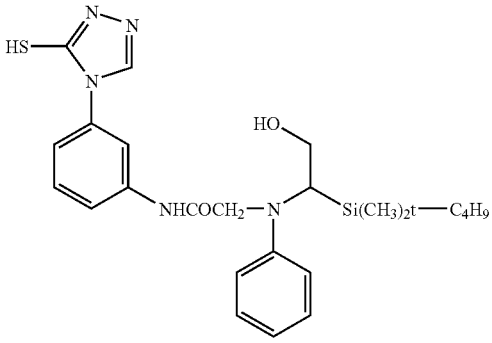
44
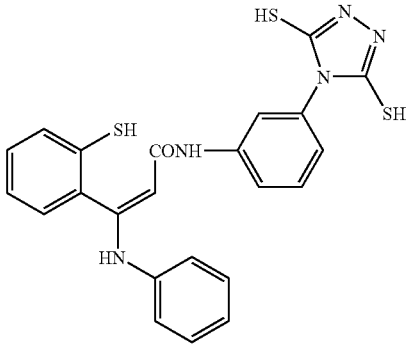

-continued

45

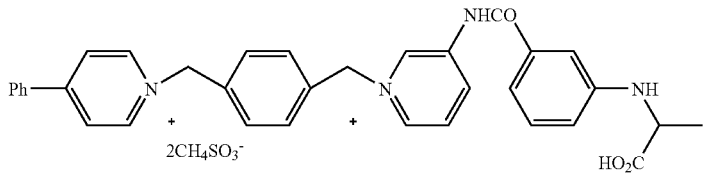

46

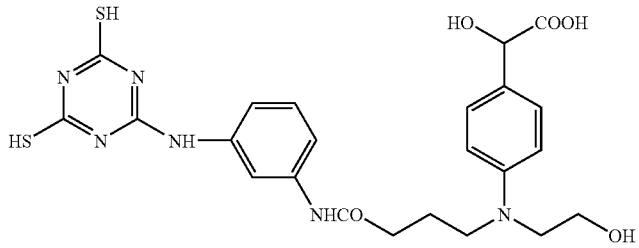

47

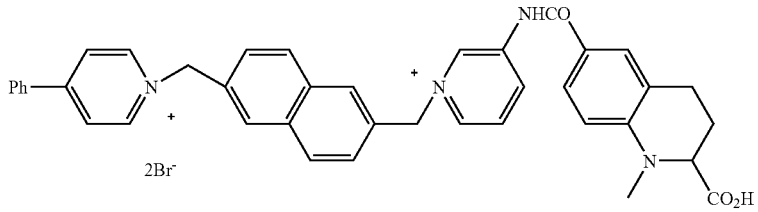

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added at the chemical sensitization step, or before coating.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer. The compound may be added to a surface protective layer, or an intermediate layer, as well as the image forming layer, to be diffused to the image forming layer in the coating step. The compound may be added before or after addition of a sensitizing dye. Each compound is contained in the image forming layer preferably in an amount of from $1\times10^{-9}$ mol to $5\times10^{-2}$ mol, more preferably from $1\times10^{-8}$ mol to $2\times10^{-3}$ mol, per 1 mol of silver halide.

10) Compound Having Adsorptive Group and Reducing Group

The photothermographic material of the present invention preferably comprises a compound having an adsorptive group to silver halide and a reducing group in a molecule. It is preferred that the compound is represented by the following formula (I).

A—(W)n-B Formula (I)

In formula (I), A represents a group capable of adsorption to a silver halide (hereafter, it is called an adsorptive group); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as an adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as an adsorptive group may become a thione group by a tautomerization.

The thione group used as the adsorptive group also includes a linear or cyclic thioamide group, thioureido group, thiourethane group, and dithiocarbamate ester group.

The heterocyclic group, as an adsorptive group, which contains at least one atom selected from a nitrogen atom, a sulfur atom, a selenium atom, or a tellurium atom represents a nitrogen-containing heterocyclic group having —NH— group, as a partial structure of a heterocycle, forming a silver iminate (>NAg) or a heterocyclic group having an —S— group, a —Se— group, a —Te— group or a =N— group as a partial structure of a heterocycle, and coordinating to a silver ion by a coordinate bond. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No. 11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group capable to form an imino-silver (>NAg) as a partial structure of heterocycle (e.g., a benzotriazole group, a benzimidazole group, an indazole group, or the like) are preferable, and more preferable as an adsorptive group are a 2-mercaptobenzimidazole group and a 3,5-dimercapto-1,2,4-triazole group.

In formula (I), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (e.g., a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (e.g., a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (I), a reducing group represented by B represents the group capable to reduce a silver ion. As the examples, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like can be described. They may have any substituent.

The oxidation potential of a reducing group represented by B in formula (I), can be measured by using the measuring method described in Akira Fujishima, "DENKIKAGAKU SOKUTEIHO", pages 150 to 208, GIHODO SHUPPAN and The Chemical Society of Japan, "ZIKKEN KAGAKUKOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducing group represented by B in the present invention is measured by the method described above, an oxidation potential is preferably in a range of from −0.3 V to 1.0 V, more preferably from −0.1 V to 0.8 V, and particularly preferably from 0 V to 0.7 V.

In formula (I), a reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have the ballasted group or polymer chain in it generally used in the non-moving photographic additives as a coupler. And as a polymer, for example, the polymer described in JP-A No. 1-100530 can be selected.

The compound of formula (I) according to the present invention may be bis or tris type of compound. The molecular weight of the compound represented by formula (I) according to the present invention is preferably from 100 to 10000, more preferably from 120 to 1000, and particularly preferably from 150 to 500.

The examples of the compound represented by formula (I) according to the present invention are shown below, but the present invention is not limited in these.
(1)
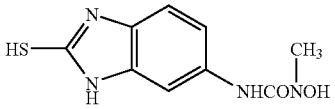
(2)
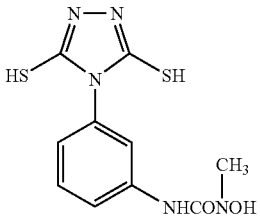
(3)
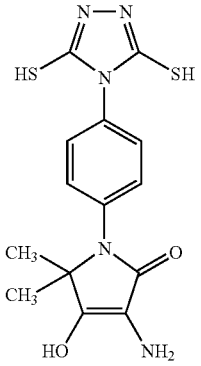
(4)
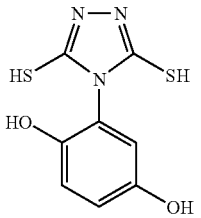
(5)
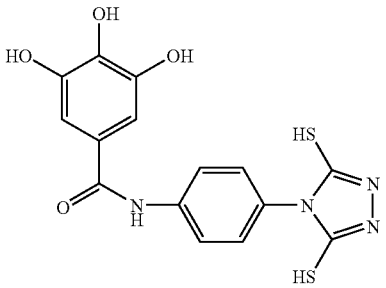
-continued
(6)
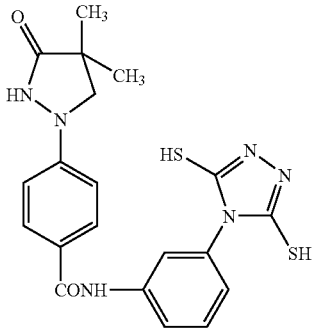
(7)
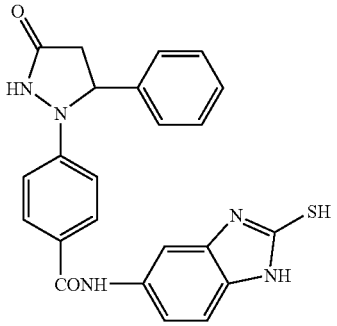
(8)
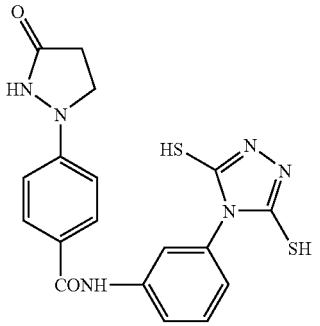
(9)
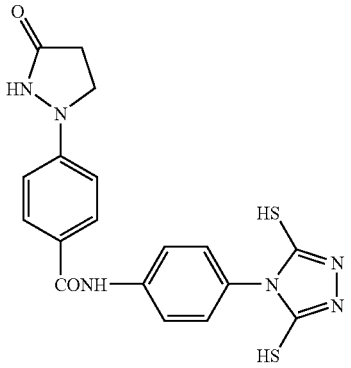

-continued (10)

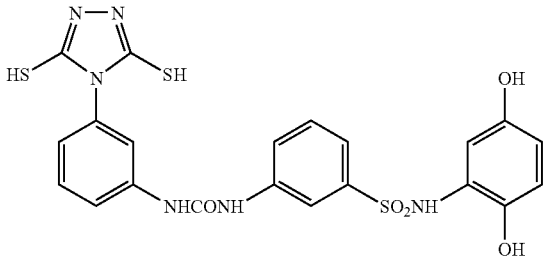

(11)

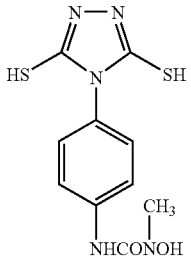

(12)

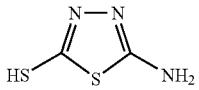

(13)

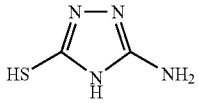

Further, example compounds 1 to 30 and 1"-1 to 1"-77 shown in EP No. 1308776A2, pages 73 to 87 are also described as preferable examples of the compound having an adsorptive group and a reducing group according to the invention.

These compounds can be easily synthesized by any known method. The compound of formula (I) according to the present invention can be used alone, but it is preferred to use two or more of the compounds in combination. When two or more of the compounds are used in combination, those may be added to the same layer or the different layers, whereby adding methods may be different from each other.

The compound represented by formula (I) according to the present invention is preferably added to an image forming layer and more preferably is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer in the coating step.

The preferred addition amount is largely dependent on the adding method described above or the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (I) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Mixing Photosensitive Silver Halide and Organic Silver Salt

The method of mixing separately prepared the photosensitive silver halide and the organic silver salt can include a method of mixing prepared photosensitive silver halide grains and organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling the photographic properties.

12) Mixing Silver Halide Into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

10. Binder for Image Forming Layer

Any kind of polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly (methacrylic acids), styrene-maleic anhydride copolymers, styrene-acrylonitrile copolymers, styrene-butadiene copolymers, poly(vinyl acetals) (e.g., poly(vinyl formal) or poly (vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent or emulsion to form a coating solution.

The glass transition temperature (Tg) of the binder of the image forming layer is preferably in a range of from 0° C.

to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer (ΣXi=1), and Tgi is the glass transition temperature (absolute temperature) of the homopolymer obtained with the ith monomer. The symbol Σ stands for the summation from i=1 to i=n.

Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be one kind or may be two or more polymers depending on needs. And, the polymer having Tg of 20° C. or more and the polymer having Tg of less than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower under 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As water-miscible organic solvents, there can be used, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term "aqueous solvent" is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under } 25^\circ\text{C. and } 60\%\ RH = [(W1 - W0)/W0] \times 100\ (\%\ \text{by weight})$$

wherein, W1 is the weight of the polymer in moisture-controlled equilibrium under the atmosphere of 25° C. and 60% RH, and W0 is the absolutely dried weight at 25° C. of the polymer. For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are, particularly preferably, polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The average particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodisperse particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one kind of monomer is polymerized, or copolymers in which two or more kinds of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<<Specific Example of Latex>>

Specific examples of preferred polymer latexes are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59° C.)

P-3; Latex of -St(50)-Bu(47)-MAA(3)-(crosslinking, Tg −17° C.)

P-4; Latex of -St(68)-Bu(29)-AA(3)-(crosslinking, Tg 17° C.)

P-5; Latex of -St(71)-Bu(26)-AA(3)-(crosslinking, Tg 24° C.)

P-6; Latex of -St(70)-Bu(27)-IA(3)-(crosslinking)

P-7; Latex of -St(75)-Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA(5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<<Preferable Latexes>>

Particularly preferable as the polymer latex for use in the invention is that of styrene-butadiene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range of from 1% by weight to 6% by weight with respect to the sum of styrene and butadiene, and more preferably from 2% by weight to 5% by weight. The polymer latex of the invention preferably contains acrylic acid. Preferable range of molecular weight is similar to that described above.

As the latex of styrene-butadiene copolymer preferably used in the invention, there can be mentioned P-3 to P-8, and P-15, or commercially available LACSTAR 3307B, LACSTAR 7132C, Nipol Lx416, and the like.

In the image forming layer of the photothermographic material according to the invention, if necessary, there may be added a hydrophilic polymer such as gelatin, poly(vinyl alcohol), methyl cellulose, hydroxypropyl cellulose, carboxymethyl cellulose, or the like. The hydrophilic polymer is added in an amount of 30% by weight or less, and preferably 20% by weight or less, with respect to a total weight of the binder of the image forming layer.

According to the invention, the image forming layer is preferably formed by using a polymer latex for the binder. Concerning the amount of the binder for the image forming layer, the mass ratio of total binder to organic silver salt (total binder/organic silver salt) is preferably in a range of from 1/10 to 10/1, and more preferably from 1/5 to 4/1.

The image forming layer is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably, from 10 to 200.

A total amount of the binder in the image forming layer according to the present invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. Concerning the image forming layer of the invention, there may be added a crosslinking agent for crosslinking, a surfactant to improve coating ability, or the like.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

11. Antifoggant

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP-A No. 1048975. Furthermore, the antifoggant preferably used in the invention is an organic halogen compound, and those disclosed in paragraph Nos. 0111 to 0112 of JP-A No. 11-65021 can be enumerated as examples thereof. In particular, the organic halogen compound expressed by formula (P) in JP-A No. 2000-284399, the organic polyhalogen compound expressed by formula (11) in JP-A No. 10-339934, and organic polyhalogen compounds described in JP-A Nos. 2001-31644 and 2001-33911 are preferred.

1) Organic Polyhalogen Compound

Preferable organic polyhalogen compound that can be used in the invention is explained specifically below. In the invention, preferred organic polyhalogen compound is the compound expressed by the following formula (H).

$$Q—(Y)n-C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an aryl group, or a heterocyclic group. In formula (H), when Q is a heterocyclic group, Q is preferably a nitrogen containing heterocyclic group having 1 or 2 nitrogen atoms, and Q is particularly preferably a 2-pyridyl group or a 2-quinolyl group.

In formula (H), when Q is an aryl group, Q is preferably a phenyl group substituted by an electron-attracting group whose Hammett substituent coefficient σ p yields a positive value. For the details of Hammett substituent coefficient, reference can be made to Journal of Medicinal Chemistry, vol. 16, No. 11 (1973), pp. 1207 to 1216, and the like. As such electron-attracting group, examples include halogen atoms (fluorine atom (σ p value: 0.06), chlorine atom (σ p value: 0.23), bromine atom (σ p value: 0.23), iodine atom (σ p value: 0.18)), trihalomethyl groups (tribromomethyl (σ p value: 0.29), trichloromethyl (σ p value: 0.33), trifluoromethyl (σ p value: 0.54)), a cyano group (σ p value: 0.66), a nitro group (σ p value: 0.78), an aliphatic aryl sulfonyl group or a heterocyclic sulfonyl group (for example, methanesulfonyl (σ p value: 0.72)), an aliphatic aryl acyl group or a heterocyclic acyl group (for example, acetyl (σ p value: 0.50) and benzoyl (σ p value: 0.43)), an alkynyl (e.g., C≡CH (σ p value: 0.23)), an aliphatic aryl oxycarbonyl group or a heterocyclic oxycarbonyl group (e.g., methoxycarbonyl (σ p value: 0.45) and phenoxycarbonyl (σ p value: 0.44)), a carbamoyl group (σ p value: 0.36), a sulfamoyl group (σ p value: 0.57), a sulfoxido group, a heterocyclic group, a phosphoryl group, and the like. Preferred range of the (σ p value is from 0.2 to 2.0, and more preferably, from 0.4 to 1.0. Preferred as the electron-attracting group are a carbamoyl group, an alkoxycarbonyl group, an alkylsulfonyl group, and an alkylphosphoryl group, and particularly preferred among them is a carbamoyl group.

X is preferably an electron-attracting group, more preferably a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, or a sulfamoyl group, and particularly preferably a halogen atom. Among halogen atoms, preferred are chlorine atom, bromine atom, and iodine atom; more preferred are chlorine atom and bromine atom; and particularly preferred is bromine atom.

Y preferably represents —C(=O)—, —SO—, or —$SO_2$—; more preferably, —C(=O)—, or —$SO_2$—; and particularly preferably, —$SO_2$—. n represents 0 or 1, and preferred is 1.

Specific examples of the compound expressed by formula (H) of the invention are shown below.

H-1

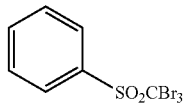

H-2

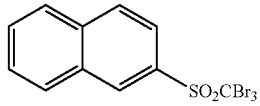

H-3

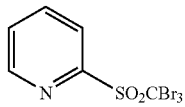

H-4

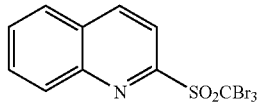

H-5

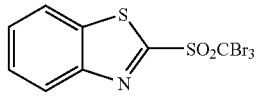

H-6

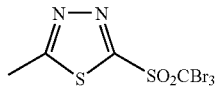

H-7

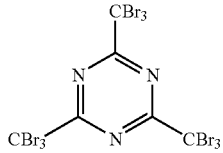

H-8

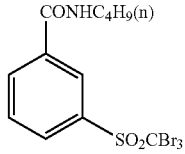

H-9

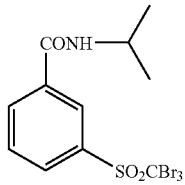

H-10

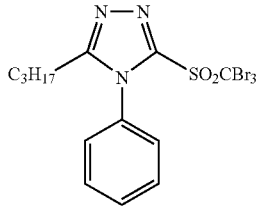

H-11

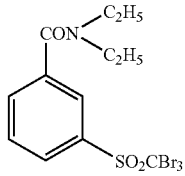

-continued

H-12

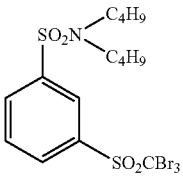

H-13

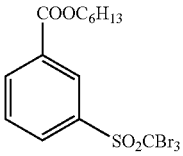

H-14

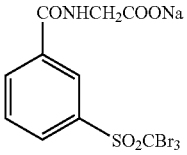

H-15

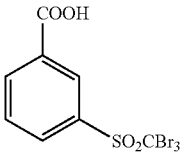

H-16

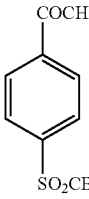

H-17

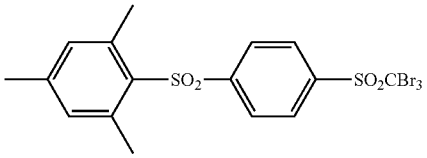

H-18

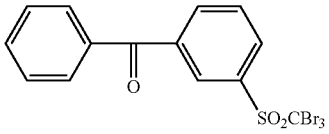

H-19

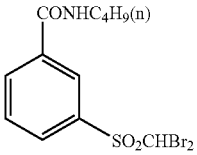

H-20

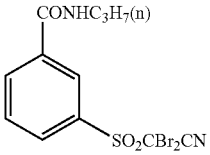

-continued

H-21

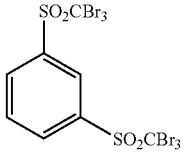

H-22

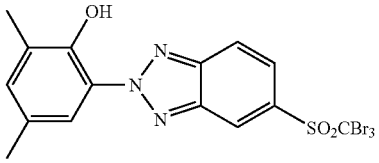

H-23

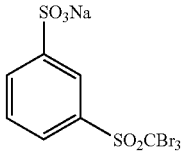

H-24

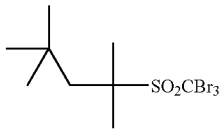

As preferred organic polyhalogen compounds of the invention other than those above, there can be mentioned compounds disclosed in JP-A Nos. 2001-31644, 2001-56526, and 2001-209145.

The compound expressed by formula (H) of the invention is preferably used in an amount of from $10^{-4}$ mol to 1 mol, more preferably, from $10^{-3}$ mol to 0.5 mol, and even more preferably, from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound expressed by formula (S) in JP-A No. 2000-221634, a triazine compound related to Claim 9 of JP-A No. 11-352624, a compound expressed by formula (III), 4-hydroxy-6-methyl-1,3,3a,7-tetrazaindene and the like, described in JP-A No. 6-11791.

The photothermographic material of the invention may further contain an azolium salt in order to prevent fogging. Azolium salts useful in the present invention include a compound expressed by formula (XI) described in JP-A No. 59-193447, a compound described in Japanese Patent Application Publication (JP-B) No. 55-12581, and a compound expressed by formula (II) in JP-A No. 60-153039. The azolium salt may be added to any part of the photothermographic material, but as an additional layer, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the salt after preparing the organic silver salt and just before coating.

As the method for adding the azolium salt, any method using a powder, a solution, a fine-particle dispersion, or the like, may be used. Further, it may be added as a solution having mixed therein other additives such as a sensitizing agent, a reducing agent, a toner, and the like.

In the invention, the azolium salt may be added at any amount, but preferably, it is added in a range of from $1\times10^{-6}$ mol to 2 mol, and more preferably, from $1\times10^{-3}$ mol to 0.5 mol, per 1 mol of silver.

12. Other Additives

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storage properties before and after development. Descriptions can be found in paragraph numbers 0067 to 0069 of JP-A No. 10-62899, a compound expressed by formula (1) of JP-A No. 10-186572 and specific examples thereof shown in paragraph numbers 0033 to 0052, in lines 36 to 56 in page 20 of EP No. 0803764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, the addition of a toner is preferred. The description of the toner can be found in JP-A No. 10-62899 (paragraph numbers 0054 to 0055), EP No. 0803764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl) phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachloro phthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants usable in the image forming layer of the invention are described in paragraph No. 0117 of JP-A No. 11-65021. Lubricants are described in paragraph Nos. 0061 to 0064 of JP-A No. 11-84573.

4) Dyes and Pigments

From the viewpoint of improving color tone, preventing the generation of interference fringes and preventing irradiation on laser exposure, various kinds of dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition and addition amount can be found in paragraph No. 0118 of JP-A No. 11-65021, paragraph Nos. 0136 to 0193 of JP-A No. 11-223898, as compounds expressed by formulae (H), (1) to (3), (A), and (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably, from 0.5 $mg/m^2$ to 100 $mg/m^2$.

6) Preparation of Coating Solution and Coating

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

13. Layer Constitution and Constituent Components

The photothermographic material of the invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components may be incorporated in the second image forming layer or in both of the layers.

The photothermographic material according to the present invention has at least one non-photosensitive layer in addition to the image forming layer. In general, non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

At least one non-photosensitive layer according to the present invention contains the above-described binder and crosslinking agent precursor, and the said non-photosensitive layer may be a surface protective layer on the side of a support having thereon the image forming layer, or may be a back layer on the opposite side of the support from the image forming layer.

Furthermore, a layer that functions as an optical filter may be provided as (a) or (b) above. An antihalation layer may be provided as (c) or (d) to the photothermographic material.

1) Surface Protective Layer

The photothermographic material of the invention can comprise a surface protective layer with an object to prevent adhesion of the image forming layer. The surface protective layer may be a single layer, or plural layers.

In the present invention, the surface protective layer may be an outermost layer itself, or a layer may be set further on the surface protective layer as an outermost layer.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range of from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

2) Antihalation Layer

The photothermographic material of the present invention can comprise an antihalation layer provided to the side farther from the light source than the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used in an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally from 0.001 $g/m^2$ to 1 $g/m^2$.

By decoloring the dye in such a manner, the optical density after thermal development can be lowered to 0.1 or lower. Two or more thermal bleaching dyes may be used in combination in a photothermographic material. Similarly, two or more base precursors may be used in combination.

In the case of thermal decolorization by the combined use of a decoloring dye and a base precursor, it is advantageous from the viewpoint of thermal decoloring efficiency to further use a substance capable of lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

3) Back Layer

Back layers usable in the invention are described in paragraph Nos. 0128 to 0130 of JP-A No. 11-6.5021.

In the invention, coloring matters having maximum absorption in the wavelength range from 300 nm to 450 nm can be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided to the opposite side of the support from the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming layer side, or in the backside.

The photothermographic material of the invention is preferably a so-called single-sided photosensitive material, which comprises at least one layer of an image forming layer containing silver halide emulsion on one side of the support, and a back layer on the other side.

4) Matting Agent

A matting agent is preferably added to the photothermographic material of the invention in order to improve transportability. Description on the matting agent can be found in paragraphs Nos. 0126 to 0127 of JP-A No. 11-65021. The addition amount of the matting agent is preferably in a range from 1 $mg/m^2$ to 400 $mg/m^2$, and more preferably, from 5 $mg/m^2$ to 300 $mg/m^2$, with respect to the coating amount per 1 m of the photothermographic material.

The shape of the matting agent usable in the invention may be a fixed form or non-fixed form. Preferred is to use those having fixed form and globular shape. The mean particle diameter is preferably in a range of from 0.5 μm to 10 μm, more preferably, from 1.0 μm to 8.0 μm, and further preferably, from 2.0 μm to 6.0 μm. Furthermore, the particle size distribution of the matting agent is preferably set as such that the variation coefficient may become 50% or lower, more preferably, 40% or lower, and further preferably, 30% or lower. The variation coefficient, herein, is defined by (the standard deviation of particle diameter)/(mean diameter of the particle)×100. Furthermore, it is preferred to use two types of matting agents having low variation coefficient and the ratio of their mean particle diameters being higher than 3, in combination.

The level of matting on the image forming layer surface is not restricted as far as star-dust trouble occurs, but the level of matting of from 30 seconds to 2000 seconds is preferred, particularly preferred, from 40 seconds to 1500 seconds as Beck's smoothness. Beck's smoothness can be calculated easily, using Japan Industrial Standard (JIS) P8119 "The method of testing Beck's smoothness for papers and sheets using Beck's test apparatus", or TAPPI standard method T479.

The level of matting of the back layer in the invention is preferably in a range of 1200 seconds or less and 10 seconds or more; more preferably, 800 seconds or less and 20 seconds or more; and even more preferably, 500 seconds or less and 40 seconds or more, when expressed by Beck's smoothness.

In the present invention, a matting agent is preferably contained in an outermost layer, in a layer which can function as an outermost layer, or in a layer nearer to outer surface, and also preferably is contained in a layer which can function as a so-called protective layer.

5) Polymer Latex

In the present invention, polymer latex is preferably used in the surface protective layer and the back layer of the photothermographic material according to the present invention. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

6) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Surfactant

Concerning the surfactant applicable in the invention, there can be used those disclosed in paragraph numbers 0132 of JP-A No. 11-65021.

In the invention, it is preferred to use a fluorocarbon surfactant. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A No. 2000-206560 are particularly preferably used.

8) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides can include, for example, spherical, needle-like, or tabular. The needle-like particles with a ratio of (the major axis)/(the minor axis) being 2.0 or more, and more preferably in a range of from 3.0 to 50, is preferred viewed from the standpoint of the electric conductivity effect. The metal oxides is preferably used in a range of from 1 $mg/m^2$ to 1000 $mg/m^2$, more preferably from 10 $mg/m^2$ to 500 $mg/m^2$, and even more preferably from 20 $mg/m^2$ to 200 $mg/m^2$. The antistatic layer may be laid on either side of the image forming layer side or the backside, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

9) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower when coating for an image forming layer or a back layer is conducted on the support.

10) Other Additives

Furthermore, an antioxidant, stabilizing agent, plasticizer, UV absorbent, or film-forming promoting agent may be added to the photothermographic material. Each of the additives is added to either of the image forming layer or the non-photosensitive layer. Reference can be made to WO No. 98/36322, EP No. 803764A1, JP-A Nos. 10-186567 and 10-18568, and the like.

11) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG. 11*b*. 1, page 427, of the same literature. If desired, two or more layers can be coated simultaneously by the method described in pages 399 to 536 of the same literature, or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509.

Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which can form image on the photothermographic material without using other sheets such as an image-receiving material).

12) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}\ m^{-2}\ day^{-1}$ or lower at 25° C., more preferably, 10 $mL \cdot atm^{-1}\ m^{-2}\ day^{-1}$ or lower, and even more preferably, 1.0 $mL \cdot atm^{-1}\ m^{-2}\ day^{-1}$ or lower. Preferably, vapor transmittance is 10 $g \cdot atm^{-1}\ m^{-2}\ day^{-1}$ or lower, more preferably, 5 $g \cdot atm^{-1}\ m^{-2}\ day^{-1}$ or lower, and even more preferably, 1 $g \cdot atm^{-1}\ m^{-2}\ day^{-1}$ or lower.

As specific examples of a wrapping material having low oxygen transmittance and/or vapor transmittance, reference can be made to, for instance, the wrapping material described in JP-A Nos. 8-254793 and 2000-206653.

13) Other Applicable Techniques

Techniques which can be used for the photothermographic material of the invention also include those in EP No. 803764A1, EP No. 883022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

In the case of multicolor photothermographic material, each of the image forming layers is maintained distinguished from each other by incorporating functional or non-functional barrier layer between each of the image forming layers as described in U.S. Pat. No. 4,460,681.

The constitution of a multicolor photothermographic material may include combinations of two layers for those for each of the colors, or may contain all the components in a single layer as described in U.S. Pat. No. 4,708,928.

14. Image Forming Method

1) Exposure

The photothermographic material of the invention may be subjected to imagewise exposure by any known methods. Preferred is scanning exposure using laser beam. As laser beam, He—Ne laser of red through infrared emission, red laser diode, or $Ar^+$, He—Ne, He—Cd laser of blue through green emission, or blue laser diode can be used. Preferred is red to infrared laser diode and the peak wavelength of laser beam is 600 nm to 900 nm, and preferably 620 nm to 850 nm.

In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 second to 30 seconds, even more preferably from 5 seconds to 25 seconds, and particularly preferably from 7 seconds to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed,. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds.

3) System

Examples of a medical laser imager equipped with an exposing portion and a thermal developing portion include Fuji Medical Dry Laser Imager FM-DPL and DRYPIX 7000. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

15. Application of the Invention

The photothermographic material and the image forming method of the present invention are preferably used for photothermographic materials for use in medical diagnosis, photothermographic materials for use in industrial photographs, photothermographic materials for use in graphic arts, as well as for COM, through forming black and white images by silver imaging, and image forming methods using the same.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C.

Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV A-minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

| | |
|---|---|
| Formula (1) (for undercoat layer on the image forming layer side | |
| Pesresin A-520 manufactured by Takamatsu Oil & Fat Co., Ltd. (30% by weight solution) | 59 g |
| Polyethyleneglycol monononylphenylether (average ethylene oxide number = 8.5) 1% by weight solution | 5.4 g |
| MP-1000 manufactured by Soken Chemical & Engineering Co., Ltd. (polymer fine particle, mean particle diameter of 0.4 μm) | 0.91 g |
| Distilled water | 935 g |
| Formula (2) (for first layer on the backside) | |
| Styrene-butadiene copolymer latex (solid content of 40% by weight, styrene/butadiene mass ratio = 68/32) | 158 g |
| Sodium salt of 2,4-dichloro-6-hydroxy-S-triazine (8% by weight aqueous solution) | 20 g |
| 1% by weight aqueous solution of sodium laurylbenzenesulfonate | 10 ml |
| Distilled water | 854 ml |
| Formula (3) (for second layer on the backside) | |
| $SnO_2$/SbO (9/1 by mass ratio, mean particle diameter of 0.038 μm, 17% by weight dispersion) | 84 g |
| Gelatin (10% by weight aqueous solution) | 89.2 g |
| METOLOSE TC-5 manufactured by Shin-Etsu Chemical Co., Ltd. (2% by weight aqueous solution | 8.6 g |
| MP-1000 manufactured by Soken Chemical & Engineering Co., Ltd. | 0.01 g |
| 1% by weight aqueous solution of sodium dodecylbenzenesulfonate | 10 ml |
| NaOH (1% by weight) | 6 ml |
| Proxel (manufactured by Imperial Chemical Industries PLC) | 1 ml |
| Distilled water | 805 ml |

<Undercoating>

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 7.7 mL/m$^2$, and dried at 180° C. for 6 minutes. Thus, an undercoated support was produced.

(Back Layer)

1) Preparation of Coating Solution for Back Layer

<<Preparation of Dispersion of Solid Fine Particles (a) of Base Precursor>>

2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

2) Preparation of Solid Fine Particle Dispersion of Dye

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

3) Preparation of Coating Solution for Antihalation Layer

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the above-mentioned dispersion of the solid fine particles of the dye, 90 g of the above-mentioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

4) Preparation of Coating Solution for Back Surface Protective Layer

A vessel was kept at 40° C., and thereto were added 40 g of gelatin, 35 mg of benzoisothiazolinone, and 840 mL of water to allow gelatin to be dissolved. Additionally, 5.8 mL of a 1 mol/L sodium hydroxide aqueous solution, liquid paraffin emulsion at 1.5 g equivalent to liquid paraffin, 10 mL of a 5% by weight aqueous solution of sodium di(2-ethylhexyl)sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight liquid of methyl methacrylate/styrene/butyl acrylate/hydroxyethyl methacrylate/acrylic acid copolymer (mass ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

5) Coating of Back Layer

The back side of the undercoated support described above was subjected to simultaneous double coating so that the coating solution for the antihalation layer gave the coating amount of gelatin of 0.52 g/m$^2$, and so that the coating solution for the back surface protective layer gave the coating amount of gelatin of 1.7 g/m$^2$, followed by drying to produce a back layer.

(Image Forming Layer, Intermediate Layer, and Surface Protective Layers)

1. Preparations of Coating Material

1) Preparation of Silver Halide Emulsion

<Preparation of Silver Halide Emulsion 1>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate (III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate (II) in an aqueous solution was added in its entirety to give $3\times10^{-4}$ mol per 1 mol of silver.

The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<Preparation of Silver Halide Emulsion 2>

Preparation of silver halide dispersion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate (II) was deleted; further the precipitation/desalting/water washing/dispersion were carried out similar to the silver halide emulsion 1. Furthermore, the spectral sensitization, chemical sensitization, and addition of 5-methyl-2-mercaptobenzimidazole and 1-phenyl-2-heptyl-5-mercapto-1,3,4-triazole were executed to the silver halide dispersion 2 similar to the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<Preparation of Silver Halide Emulsion 3>

Preparation of silver halide dispersion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: to the silver halide dispersion 3, the addition of the methanol solution of the spectral sensitizing dye A and the spectral sensitizing dye B was changed to the solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<Preparation of Mixed Emulsion A for Coating Solution>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver. Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparation of Reducing Agent Dispersion

To 10 kg of a reducing agent (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent dispersion. Particles of the reducing agent included in the resulting reducing agent dispersion had a median diameter of 0.50 μm, and a maximum particle diameter of 1.6 μm or less.

The resultant reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resultant development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

Also concerning solid dispersions of development accelerator-2 and color-tone-adjusting agent-1, dispersion was executed similar to the development accelerator-1, and thus dispersions of 20% by weight and 15% by weight were respectively obtained.

6) Preparations of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resultant organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resultant organic polyhalogen compound dispersion was subjected to filtration with a polypropylene filter having a pore size of 3.0 μm to remove foreign substances such as dust, and stored.

7) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

8) Preparation of Aqueous Solution of Mercapto Compound

<Preparation of Aqueous Solution of Mercapto Compound-2>

Mercapto compound-2 (1-(3-methylureidophenyl)-5-mercaptotetrazole) in an amount of 20 g was dissolved in 980 g of water to give a 2.0% by weight aqueous solution.

9) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

10) Preparation of SBR Latex Liquid

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature is elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ ion : $NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid matter concentration of 44% by weight, an equilibrium moisture content at 25° C. and 60% RH of 0.6% by weight, and an ionic conductance of 4.80 mS/cm (measurement of the ionic conductance was performed using a conductivity meter CM-30S manufactured by Toa Electronics Ltd. for the latex stock solution (44% by weight) at 25° C.).

2. Preparations of Coating Solution

1) Preparation of Coating Solution for Image Forming Layer

To the dispersion of the silver salt of fatty acid obtained as described above in an amount of 1000 g and 135 mL of water were serially added 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex (Tg: 17° C.) liquid, 153 g of the reducing agent dispersion, 55 g of the hydrogen bonding compound-1 dispersion, 4.8 g of the development accelerator-1 dispersion, 5.2 g of the development accelerator-2 dispersion, 2.1 g of the color-tone-adjusting agent-1 dispersion, and 8 mL of the mercapto compound-2 aqueous solution. The mixed emulsion A for coating solution in an amount of 140 g was added thereto, followed by thorough mixing just prior to the coating, which was fed directly to a coating die, and coated.

Viscosity of the above-described coating solution for the image forming layer was 40 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 30, 43, 41, 28, and 20 [mPa·s], respectively, at the shearing rate of 0.1, 1, 10, 100, 1000 [1/second].

The amount of zirconium in the coating solution was 0.30 mg per 1 g of silver.

2) Preparation of Coating Solution for Intermediate Layer

To 1000 g of poly(vinyl alcohol) PVA-205 (manufactured by Kuraray Co., Ltd.), 163 g of the pigment-1 dispersion, 33 g of an aqueous solution of a phthalocyanine compound (manufactured by Nippon Kayaku Co., Ltd.: Kayafect turquoise RN liquid 150), 27 mL of a 5% by weight aqueous solution of sodium di(2-ethylhexyl)sulfosuccinate, 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), and 135 mL of a 20% by weight aqueous solution of diammonium phthalate was added water to give a total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/$m^2$.

Viscosity of the coating solution was 20 [mPa·s] which was measured with a B type viscometer at 40° C. (No. 1 rotor, 60 rpm).

4) Preparation of Coating Solution-1 for Second Layer of Surface Protective Layers In 800 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl)sulfosuccinate, 4 g of poly(methyl methacrylate) fine particles (mean particle diameter of 0.7 μm), and 21 g of poly(methyl methacrylate) fine particles (mean particle diameter of 4.5 μm), and the obtained mixture was mixed, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

5) Preparations of Coating Solution-2 to -15 for Second Layer of Surface Protective Layers Preparations of coating solution-2 to -15 for the second layer of surface protective layers were conducted in a similar manner to the process in the preparation of coating solution-1 for the second layer of surface protective layers, except that the comparative crosslinking agent A to E or the crosslinking agent precursor according to the present invention was added as shown in Table 1.

<Comparative crosslinking agent A>

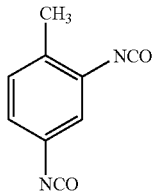

<Comparative crosslinking agent B>

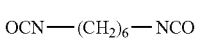

<Comparative crosslinking agent C>

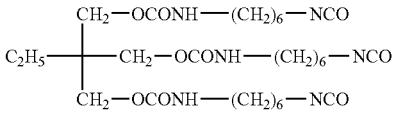

<Comparative crosslinking agent D>

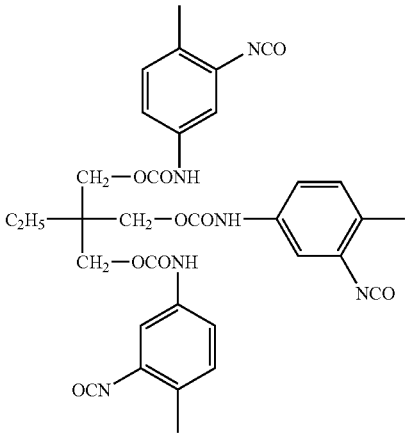

-continued

<Comparative crosslinking agent E>

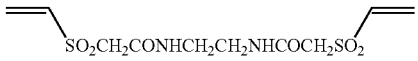

The crosslinking agent precursor according to the present invention was added by preparing the following solid fine particle dispersion thereof.

<Preparation of Solid Fine Particle Dispersion of Crosslinking Agent Precursor>

To 1 kg of a crosslinking agent precursor and 1 kg of a 10% by weight aqueous solution of poly(vinyl pyrrolidone) were added 200 g of a 20% aqueous solution of dodecyldiphenyldisulfonic acid sodium salt and 4 kg of water, and thoroughly mixed to give a slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.05 g of a benzoisothiazolinone sodium salt and water were added thereto, thereby adjusting the concentration of the crosslinking agent precursor to be 15% by weight to obtain crosslinking agent precursor dispersion. Particles of the crosslinking agent precursor included in the resulting crosslinking agent precursor dispersion had a median diameter of 0.25 μm, and a maximum particle diameter of 0.7 μm or less. The resultant crosslinking agent precursor dispersion was subjected to filtration with a polypropylene filter having a pore size of 3.0 μm to remove foreign substances such as dust, and stored.

TABLE 1

| Sample No. | Second Layer of Surface Protective Layers | Crosslinking Agent or Precursor Thereof: Kind | Crosslinking Agent or Precursor Thereof: Addition Amount (weight % vs Binder) (%) | Photographic Properties: Fog | Photographic Properties: Dmax | Photographic Properties: Sensitivity | Physical Strength: Water Resistance | Physical Strength: Scratch Resistance | Note |
|---|---|---|---|---|---|---|---|---|---|
| 101 | 1 | — | — | 0.18 | 3.85 | 100 | 2 | 3 | Comparative |
| 102 | 2 | Comparative crosslinking agent A | 3 | 0.23 | 3.12 | 85 | 3 | 2 | Comparative |

TABLE 1-continued

| Sample No. | Second Layer of Surface Protective Layers | Crosslinking Agent or Precursor Thereof: Kind | Crosslinking Agent or Precursor Thereof: Addition Amount (weight % vs Binder) (%) | Photographic Properties: Fog | Photographic Properties: Dmax | Photographic Properties: Sensitivity | Physical Strength: Water Resistance | Physical Strength: Scratch Resistance | Note |
|---|---|---|---|---|---|---|---|---|---|
| 103 | 3 | Comparative crosslinking agent B | 3 | 0.20 | 3.01 | 80 | 4 | 3 | Comparative |
| 104 | 4 | Comparative crosslinking agent C | 2 | 0.21 | 2.88 | 89 | 4 | 4 | Comparative |
| 105 | 5 | Comparative crosslinking agent D | 2 | 0.25 | 2.95 | 90 | 3 | 3 | Comparative |
| 106 | 6 | Comparative crosslinking agent E | 2 | 0.19 | 2.31 | 73 | 4 | 5 | Comparative |
| 107 | 7 | 3 | 2 | 0.17 | 3.88 | 99 | 5 | 4 | Invention |
| 108 | 8 | 11 | 2 | 0.17 | 3.86 | 100 | 5 | 4 | Invention |
| 109 | 9 | 16 | 2 | 0.17 | 3.82 | 98 | 5 | 4 | Invention |
| 110 | 10 | 17 | 2 | 0.17 | 3.81 | 97 | 5 | 4 | Invention |
| 111 | 11 | 29 | 2 | 0.17 | 3.86 | 101 | 5 | 4 | Invention |
| 112 | 12 | 30 | 2 | 0.17 | 3.84 | 99 | 5 | 4 | Invention |
| 113 | 13 | 33 | 2 | 0.18 | 3.92 | 103 | 4 | 5 | Invention |
| 114 | 14 | 38 | 2 | 0.18 | 3.94 | 102 | 4 | 5 | Invention |
| 115 | 15 | 49 | 2 | 0.18 | 3.95 | 104 | 4 | 5 | Invention |

3. Preparations of Photothermographic Material

1) Preparations of Photothermographic Material-101 to -115

Reverse surface of the back surface was subjected to simultaneous overlaying coating by a slide bead coating method in order of coating solution for the image forming layer, the coating solution for the intermediate layer, the coating solution for the first layer of surface protective layers, and the coating solution for the second layer of surface protective layers, starting from the undercoated face, and thus sample of photothermographic material was produced. Sample Nos. 101 to 115 were prepared using the corresponding coating solution-1 to -15 for the second layer of surface protective layers as a coating solution for the second layer of surface protective layers, respectively. In this method, the temperature of the coating solution was adjusted to 31° C. for the image forming layer and intermediate layer, to 36° C. for the first layer of surface protective layers, and to 37° C. for the second layer of surface protective layers.

The coating amount of each compound (g/m$^2$) for the image forming layer is as follows.

| | |
|---|---|
| Silver salt of a fatty acid | 5.27 |
| Pigment (C.I. Pigment Blue 60) | 0.036 |
| Organic polyhalogen compound-1 | 0.14 |
| Organic polyhalogen compound-2 | 0.28 |
| Phthalazine compound-1 | 0.18 |
| SBR latex | 9.43 |
| Reducing agent | 0.77 |
| Hydrogen bonding compound-1 | 0.28 |
| Development accelerator-1 | 0.019 |
| Development accelerator-2 | 0.016 |
| Color-tone-adjusting agent | 0.006 |
| Mercapto compound-2 | 0.003 |
| Silver halide (on the basis of Ag content) | 0.13 |

Conditions for coating and drying are as follows.

Coating was performed at the speed of 160 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Thus prepared photothermographic material had a level of matting of 550 seconds on the image forming layer side, and 130 seconds on the back surface as Beck's smoothness. In addition, measurement of pH of the film surface on the image forming layer side gave the result of 6.0.

Chemical structures of the compounds used in Examples of the invention are shown below.

Spectral sensitizing dye A

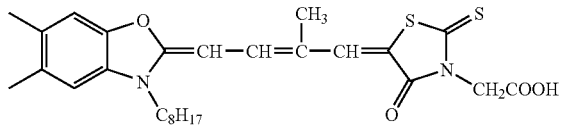

Spectral sensitizing dye B

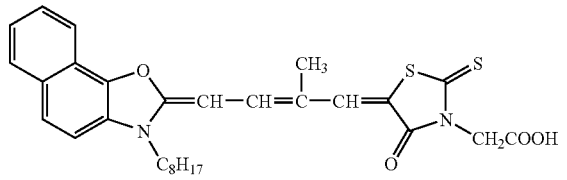

-continued

Tellurium sensitizer C

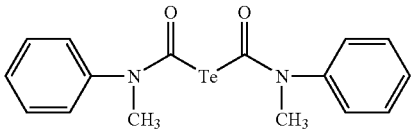

Base precursor-1

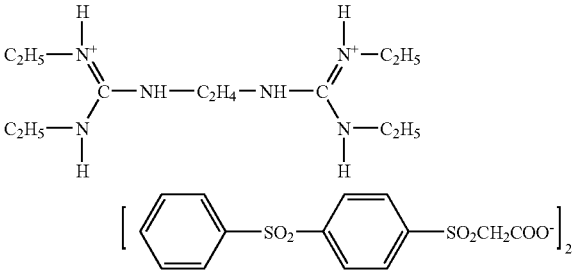

Cyanine dye-1

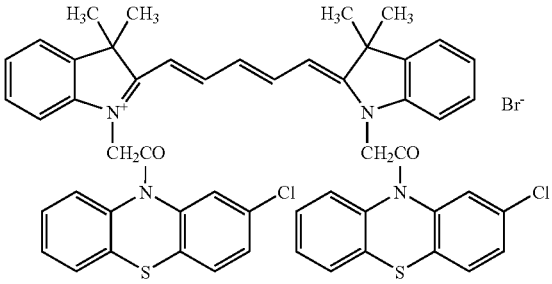

Reducing agent

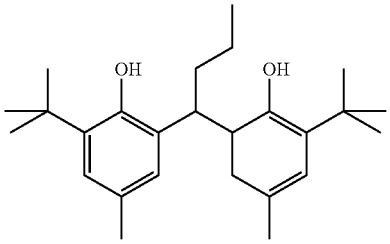

Hydrogen bonding compound-1

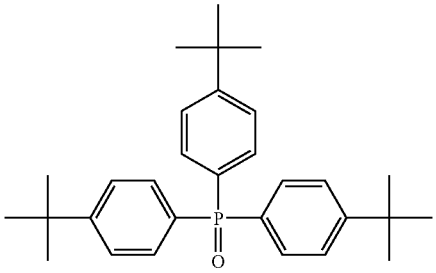

Organic polyhalogen compound-1

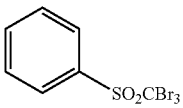

Organic polyhalogen compound-2

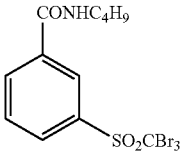

-continued

Mercapto compound-2

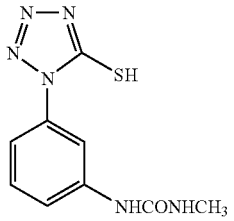

Phthalazine compound -1

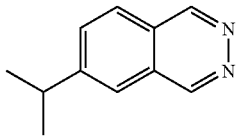

Development accelerator-1

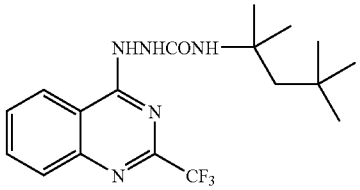

Development accelerator-2

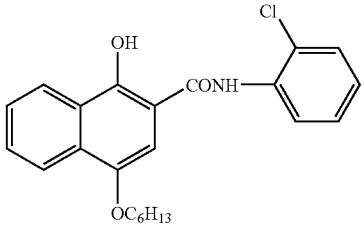

Color-tone-adjusting agent-1

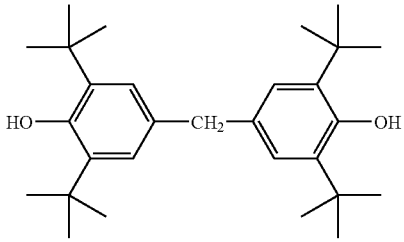

(F-1)

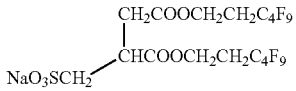

(F-2)

Mixture of

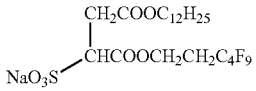

and

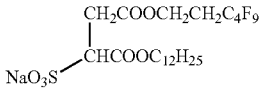

4. Evaluation of Photographic Properties 4-1. Preparation

The obtained sample was cut into a half-cut size and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1} m^{-2} day^{-1}$;

vapor permeability at 25° C.: 0.10 $g \cdot atm^{-1} m^{-2} day^{-1}$.

4-2. Exposure and Development of Photothermographic Material

To each sample, exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed.

4-3. Terms of Evaluation and Results

1) Photographic Properties

Fog: Fog is expressed in terms of a density of the unexposed portion.

Dmax: Dmax is a saturated maximum density obtained with increasing the exposure value.

Sensitivity: Sensitivity is the inverse of the exposure value giving a density of 1.0. The sensitivities are shown in relative value, detecting the sensitivity of Sample No. 101 to be 100.

2) Physical Strength of Film

<Water Resistance>

One drop of water was dropped on the surface of the photothermographic material by using a dropper, and wiped out after 10 seconds with an absorbent cotton followed by drying. The trace wiped out was observed and evaluated according to the following five points rank. The evaluation was performed with the help of a transmitted light from the lighting table and a reflective light by a fluorescent lamp in the room.

5; No trace is seen by observation with the reflective light.

4; No trace is seen on the lighting table, but slightly trace is seen by observation with the reflective light.

3; Slight trace is seen on the lighting table, but trace is apparently seen by observation with the reflective light.

2; Trace is apparently seen on the lighting table.

1; The film surface is peeled off.

<Scratch Resistance>

The degree of scratch caused by rubbing the surface of the photothermographic material with a nylon-made brush was observed and evaluated on the lighting table and by the reflective light by a fluorescent lamp according to the following five points rank.

5; No trace is seen by observation with the reflective light.

4; No trace is seen on the lighting table, but slightly trace is seen by observation with the reflective light.

3; Slight trace is seen on the lighting table, but trace is apparently seen by observation with the reflective light.

2; Trace is apparently seen on the lighting table.

1; The film surface is peeled off.

The obtained results are shown in Table 1.

It is clearly seen from the results that the compounds of the present invention can improve water resistance and scratch resistance without lowering the image density and sensitivity. Especially, the compounds represented by formula (C-2) are superior in improving water resistance, and the compounds represented by formula (C-3) are superior in improving scratch resistance. Both are preferred embodiments of the present invention.

Example 2

1. Preparations of Coated Sample

1) Preparations of Coating Solution-21 to -30 for Second Layer of Surface Protective Layers Preparations of coating solution-2 1 to -30 for the second layer of surface protective layers were conducted in a similar manner to the process in the preparation of coating solution-3 for the second layer of surface protective layers of Example 1 except that in place of the inert gelatin, poly (vinyl alcohol) (PVA-205, trade name, available from Kurary Co., Ltd.) was added in the same amount by mass as for the inert gelatin, and thereafter, the comparative crosslinking agent B or the crosslinking agent precursor of the present invention (shown in Table 2) was added.

2) Coating

Sample Nos. 201 to 210 were prepared in a similar manner to the process in the preparation of sample No. 103 of Example 1, except that changing the coating solution for the second layer of the surface protective layers to Nos. 21 to 30.

2. Evaluation of Performance

Samples were evaluated similar to Example 1, and the obtained results are shown in Table 2.

It is clearly seen from the results that the compounds of the present invention can improve water resistance and scratch resistance without lowering the image density and sensitivity.

Especially, it is understood that the compounds represented by formula (C-2) are superior in improving water resistance, and the compounds represented by formula (C-3) are superior in improving scratch resistance. Both are preferred embodiments of the present invention.

TABLE 2

| Sample No. | Second Layer of Surface Protective Layers | Crosslinking Agent or Precursor Thereof: Kind | Addition Amount (weight % vs Binder) (%) | Photographic Properties: Fog | Dmax | Sensitivity | Physical Strength: Water Resistance | Scratch Resistance | Note |
|---|---|---|---|---|---|---|---|---|---|
| 201 | 21 | — | — | 0.19 | 3.80 | 100 | 3 | 2 | Comparative |
| 202 | 22 | Comparative crosslinking agent B | 4 | 0.21 | 2.95 | 82 | 4 | 3 | Comparative |
| 203 | 23 | 3 | 4 | 0.17 | 3.78 | 98 | 5 | 4 | Invention |

TABLE 2-continued

| Sample No. | Second Layer of Surface Protective Layers | Crosslinking Agent or Precursor Thereof: Kind | Crosslinking Agent or Precursor Thereof: Addition Amount (weight % vs Binder) (%) | Photographic Properties: Fog | Photographic Properties: Dmax | Photographic Properties: Sensitivity | Physical Strength: Water Resistance | Physical Strength: Scratch Resistance | Note |
|---|---|---|---|---|---|---|---|---|---|
| 204 | 24 | 11 | 4 | 0.17 | 3.81 | 101 | 5 | 4 | Invention |
| 205 | 25 | 16 | 4 | 0.17 | 3.80 | 99 | 5 | 4 | Invention |
| 206 | 26 | 17 | 4 | 0.17 | 3.76 | 100 | 5 | 4 | Invention |
| 207 | 27 | 29 | 4 | 0.17 | 3.77 | 99 | 5 | 4 | Invention |
| 208 | 28 | 33 | 4 | 0.18 | 3.85 | 104 | 4 | 5 | Invention |
| 209 | 29 | 38 | 4 | 0.18 | 3.89 | 106 | 4 | 5 | Invention |
| 210 | 30 | 49 | 4 | 0.18 | 3.87 | 105 | 4 | 5 | Invention |

Example 3

1. Preparations of Sample

1) Preparations of Coating Solution-31 to -40 for Second Layer of Surface Protective Layers Preparations of coating solution-31 to -40 for the second layer of surface protective layers were conducted in a similar manner to the process in the preparation of coating solution-3 for the second layer of surface protective layers of Example 1 except that the inert gelatin and 19% by weight liquid of methacrylate/styrene/butylacrylate/hydroxyethyl methacrylate/acrylic acid copolymer (mass ratio of the copolymerization of 57/8/28/5/2) latex were omitted, but instead poly(vinyl alcohol) (PVA-205, trade name, available from Kurary Co., Ltd.), polymer latex (SBR) comprising 20% by weight aqueous solution of LP-4 (styrene/butadiene/acrylic acid copolymer, mass ratio of the copolymerization of 68/29/3; crosslinking, Tg: 17° C. ), and polymer latex (SIR) comprising 20% by weight aqueous solution of styrene/isoprene/acrylic acid copolymer (mass ratio of the copolymerization of 62/35/3, crosslinking, Tg: 15° C. ) were added in the equal amount respectively, and thereafter, the comparative crosslinking agent C or the crosslinking agent precursor of the present invention (shown in Table 3) was added.

2) Coating

Sample Nos. 301 to 310 were prepared in a similar manner to the process in the preparation of sample No. 103 of Example 1, except that changing the coating solution for the second layer of the surface protective layers to Nos. 31 to 40.

2. Evaluation of Performance

Samples were evaluated similar to Example 1, and the obtained results are shown in Table 3.

It is clearly seen from the results that the compounds of the present invention can improve water resistance and scratch resistance without lowering the image density and sensitivity.

Especially, it is understood that the compounds represented by formula (C-2) are superior in improving water resistance, and the compounds represented by formula (C-3) are superior in improving scratch resistance. Both are preferred embodiments of the present invention.

Example 4

Samples were prepared by adding the crosslinking agent precursor No. 30 and No. 33 of the present invention in the equal amount by mass in place of N,N-ethylene(vinylsulfone acetamide) used in the back surface protective layer of Example 1. The back surfaces of the obtained samples were evaluated on water resistance and scratch resistance similar to Example 1. As a result, samples including the crosslinking agent precursor of the present invention exhibit excellent results in water resistance and scratch resistance.

TABLE 3

| Sample No. | Second Layer of Surface Protective Layers | Latex | Crosslinking Agent or Precursor Thereof: Kind | Crosslinking Agent or Precursor Thereof: Addition Amount (weight % vs Binder) (%) | Photographic Properties: Fog | Photographic Properties: Dmax | Photographic Properties: Sensitivity | Physical Strength: Water Resistance | Physical Strength: Scratch Resistance | Note |
|---|---|---|---|---|---|---|---|---|---|---|
| 301 | 31 | SBR | — | — | 0.18 | 3.86 | 100 | 3 | 3 | Comparative |
| 302 | 32 | SBR | Comparative crosslinking agent C | 2 | 0.22 | 2.68 | 99 | 4 | 3 | Comparative |
| 303 | 33 | SBR | 3 | 2 | 0.17 | 3.85 | 98 | 5 | 4 | Invention |
| 304 | 34 | SBR | 11 | 2 | 0.17 | 3.88 | 100 | 5 | 4 | Invention |
| 305 | 35 | SBR | 16 | 2 | 0.17 | 3.84 | 98 | 5 | 4 | Invention |
| 306 | 36 | SIR | 17 | 2 | 0.17 | 3.83 | 99 | 5 | 5 | Invention |

TABLE 3-continued

| Sample No. | Second Layer of Surface Protective Layers | Latex | Crosslinking Agent or Precursor Thereof Kind | Addition Amount (weight % vs Binder) (%) | Photographic Properties Fog | Dmax | Sensitivity | Physical Strength Water Resistance | Scratch Resistance | Note |
|---|---|---|---|---|---|---|---|---|---|---|
| 307 | 37 | SIR | 29 | 2 | 0.17 | 3.85 | 101 | 5 | 5 | Invention |
| 308 | 38 | SIR | 33 | 2 | 0.18 | 3.92 | 104 | 5 | 5 | Invention |
| 309 | 39 | SBR | 38 | 2 | 0.18 | 3.90 | 103 | 4 | 5 | Invention |
| 310 | 40 | SBR | 49 | 2 | 0.18 | 3.93 | 105 | 4 | 5 | Invention |

What is claimed is:

1. A photothermographic material comprising an image forming layer comprising at least a photosensitive silver halide, a non-photosensitive organic silver salt, and a reducing agent, and at least one non-photosensitive layer on a support, wherein the non-photosensitive layer comprises a crosslinking agent precursor, in which the crosslinking agent precursor is a compound which releases a crosslinking agent which crosslinks a binder of the non-photosensitive layer at the time of thermal development, wherein the crosslinking agent precursor is a compound represented by the following formula (C-1):

Formula (C-1)

wherein in formula (C-1), X represents an aromatic group or a heterocyclic group; Y represents one selected from an $SO_2NH$ group, an $SO_3$ group, a CONH group, a COO group, and an NHNH group; L represents a linking group having a valency of from 2 to 6; and m represents an integer of from 2 to 6.

2. The photothermographic material according to claim 1, wherein, in formula (C-1), X represents a heterocyclic group, and Y represents an $SO_2NH$ group.

3. The photothermographic material according to claim 1, wherein, in formula (C-1), X represents a heterocyclic group, and Y represents an NHNH group.

4. The photothermographic material according to claim 1, wherein the crosslinking agent precursor is a compound represented by the following formula (C-2):

Formula (C-2)

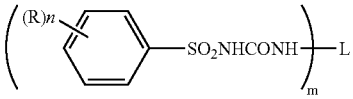

wherein in formula (C-2), R represents a group substituting for a hydrogen atom on a benzene ring; L represents a linking group having a valency of from 2 to 6; m represents an integer of from 2 to 6; and n represents an integer of from 0 to 5.

5. The photothermographic material according to claim 4, wherein, in formula (C-2), R represents an electron-attracting group.

6. The photothermographic material according to claim 4, wherein, in formula (C-2), n represents an integer of from 1 to 3.

7. The photothermographic material according to claim 1, wherein the crosslinking agent precursor is a compound represented by the following formula (C-3):

Formula (C-3)

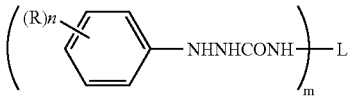

wherein in formula (C-3), R represents a group substituting for a hydrogen atom on a benzene ring; L represents a linking group having a valency of from 2 to 6; m represents an integer of from 2 to 6; and n represents an integer of from 0 to 5.

8. The photothermographic material according to claim 7, wherein, in formula (C-3), R represents an electron-attracting group.

9. The photothermographic material according to claim 7, wherein, in formula (C-3), n represents an integer of from 1 to 3.

10. The photothermographic material according to claim 1, wherein the photothermographic material further comprises a compound represented by the following formula (P):

Formula (P)

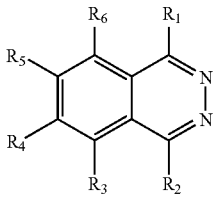

wherein $R_1$ to $R_6$ each independently represent a hydrogen atom or a substituent.

11. The photothermographic material according to claim 1, wherein the binder contains a water-soluble polymer which is derived from non-animal protein in an amount of 50% by weight or more.

12. The photothermographic material according to claim 11, wherein the water-soluble polymer which is derived from non-animal protein contains any one of a carboxy group or a salt thereof, a thiol group, a phenolic hydroxy group, a carboxylic anhydride group, an epoxy group, an amide group, or an aromatic amino group.

13. The photothermographic material according to claim 12, wherein the water-soluble polymer which is derived from non-animal protein contains a carboxy group or a salt thereof.

14. The photothermographic material according to claim 1, wherein the binder contains a water-soluble polymer derived from animal protein in an amount of 50% by weight or more.

15. The photothermographic material according to claim 14, wherein the water-soluble polymer derived from animal protein is gelatin.

16. The photothermographic material according to claim 11, wherein less than 50% by weight of the binder is a polymer latex.

17. The photothermographic material according to claim 16, wherein the polymer latex contains any one of a carboxy group or a salt thereof, a thiol group, a phenolic hydroxy group, a carboxylic anhydride group, an epoxy group, an amide group, or an aromatic amino group.

18. The photothermographic material according to claim 17, wherein the polymer latex contains a carboxy group or a salt thereof.

19. The photothermographic material according to claim 14, wherein less than 50% by weight of the binder is a polymer latex.

20. The photothermographic material according to claim 19, wherein the polymer latex contains any one of a carboxy group or a salt thereof, a thiol group, a phenolic hydroxy group, a carboxylic anhydride group, an epoxy group, an amide group, or an aromatic amino group.

21. The photothermographic material according to claim 20, wherein the polymer latex contains a carboxy group or a salt thereof.

22. The photothermographic material according to claim 1, wherein the non-photosensitive layer is a surface protective layer which is on the same side of the support as the image forming layer.

23. The photothermographic material according to claim 1, wherein the non-photosensitive layer is a back layer which is on an opposite side of the support from the image forming layer.

* * * * *